US010087037B2

(12) United States Patent
Sager et al.

(10) Patent No.: US 10,087,037 B2
(45) **Date of Patent: *Oct. 2, 2018**

(54) CYLINDRICAL SLEEVE

(71) Applicant: Berry Global Films, LLC, Evansville, IN (US)

(72) Inventors: Randy P. Sager, Newport Coast, CA (US); David Cron, Ho Ho Kus, NJ (US); David A. Rudd, Lake George, NY (US)

(73) Assignee: Berry Global Films, LLC, Evansville, IN (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/647,340

(22) Filed: Jul. 12, 2017

(65) Prior Publication Data

US 2017/0305709 A1 Oct. 26, 2017

Related U.S. Application Data

(63) Continuation of application No. 14/572,273, filed on Dec. 16, 2014, now Pat. No. 9,731,932, which is a (Continued)

(51) Int. Cl.
*B65H 75/04* (2006.01)
*B65H 75/18* (2006.01)

(Continued)

(52) U.S. Cl.
CPC ..... *B65H 75/04* (2013.01); *B65B 67/085* (2013.01); *B65H 75/10* (2013.01); *B65H 75/185* (2013.01);

(Continued)

(58) Field of Classification Search
CPC ..... B65H 75/08; B65H 75/10; B65H 75/18; B65H 75/04; B65H 2701/1944;

(Continued)

(56) References Cited

U.S. PATENT DOCUMENTS 2,219,836 A 10/1940 Dunlap
3,581,744 A * 6/1971 Voss ..... A61F 13/2085 428/34.2

(Continued)

FOREIGN PATENT DOCUMENTS

WO 1993010006 5/1993
WO 2011154745 12/2011

OTHER PUBLICATIONS

International Search Report and Written Opinion for Application No. PCT/US2015/15022 dated May 20, 2015, 18 pages.

*Primary Examiner* — William A. Rivera
(74) *Attorney, Agent, or Firm* — Barnes & Thornburg LLP

(57) ABSTRACT

An assembly is disclosed. The assembly includes a cylindrical sleeve and a length of material that is wound upon itself defining a wound roll. The cylindrical sleeve includes an inner surface and an outer surface. The inner surface of the cylindrical sleeve defines a passage extending through the cylindrical sleeve. The length of material includes an inner surface and an outer surface. A portion of the inner surface of the length of material forms a passage extending through the wound roll. The outer surface of the cylindrical sleeve is secured to the portion of the inner surface of the length of material that forms the passage extending through the wound roll. The wound roll forms an upper axial end and a lower axial end. The wound roll is defined by a length extending between the upper axial end and the lower axial end. The cylindrical sleeve forms a distal end and a proximal end. The cylindrical sleeve is defined by a length extending between the distal end and the proximal end. The length of the cylindrical sleeve is greater than the length of the wound roll to thereby define a first portion of the length of the cylindrical sleeve that extends beyond the upper axial end of the wound roll and a second portion of the length of the (Continued)

cylindrical sleeve that extends beyond the lower axial end of the wound roll. Both of the first portion of the length of the cylindrical sleeve and the second portion of the length of the cylindrical sleeve is defined by a Sheffield Smoothness that is less than 350. A method is also disclosed.

20 Claims, 20 Drawing Sheets

Related U.S. Application Data continuation-in-part of application No. 14/175,575, filed on Feb. 7, 2014, now Pat. No. 9,481,536.

(51) Int. Cl.
*B65H 75/10* (2006.01)
*B65B 67/08* (2006.01)

(52) U.S. Cl.
CPC ... *B65H 2402/412* (2013.01); *Y10T 428/1334* (2015.01)

(58) Field of Classification Search
CPC ..... B65H 2701/50; B65H 2701/51; B65H 27/00; B65H 18/28; B65H 2402/412; B65B 67/085; B65B 11/00; B65B 67/08; B65D 85/672; Y10T 428/1334
See application file for complete search history.

(56) References Cited

U.S. PATENT DOCUMENTS

| | | | | |
|---|---|---|---|---|
| 5,505,395 | A * | 4/1996 | Qiu | B31C 3/00 138/140 |
| 5,555,978 | A | 9/1996 | Elsner | |
| 5,908,173 | A * | 6/1999 | De Roeck | B65H 18/00 242/609.4 |
| 5,910,353 | A | 6/1999 | Machlica | |
| 7,188,800 | B2 * | 3/2007 | Bessems | B31C 3/00 242/610 |
| 7,204,451 | B2 * | 4/2007 | van de Camp | B65H 18/02 242/609 |
| 9,481,536 | B2 * | 11/2016 | Sager | B65H 18/28 |
| 9,731,932 | B2 * | 8/2017 | Sager | B65B 67/085 |
| 2006/0102773 | A1 * | 5/2006 | Kewin | B65H 75/505 242/610.1 |
| 2009/0047525 | A1 | 2/2009 | Tilton | |
| 2011/0057069 | A1 | 3/2011 | Hernandez | |
| 2013/0248643 | A1 * | 9/2013 | Newhouse | B65H 19/20 242/526 |

* cited by examiner

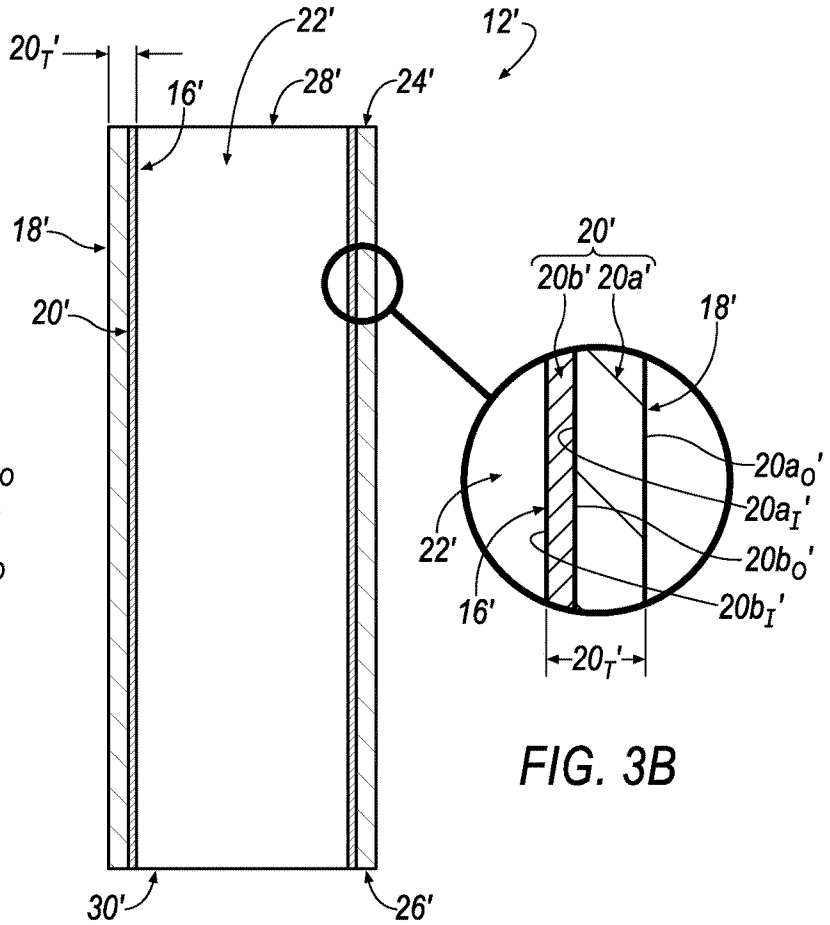
FIG. 2B
FIG. 3B
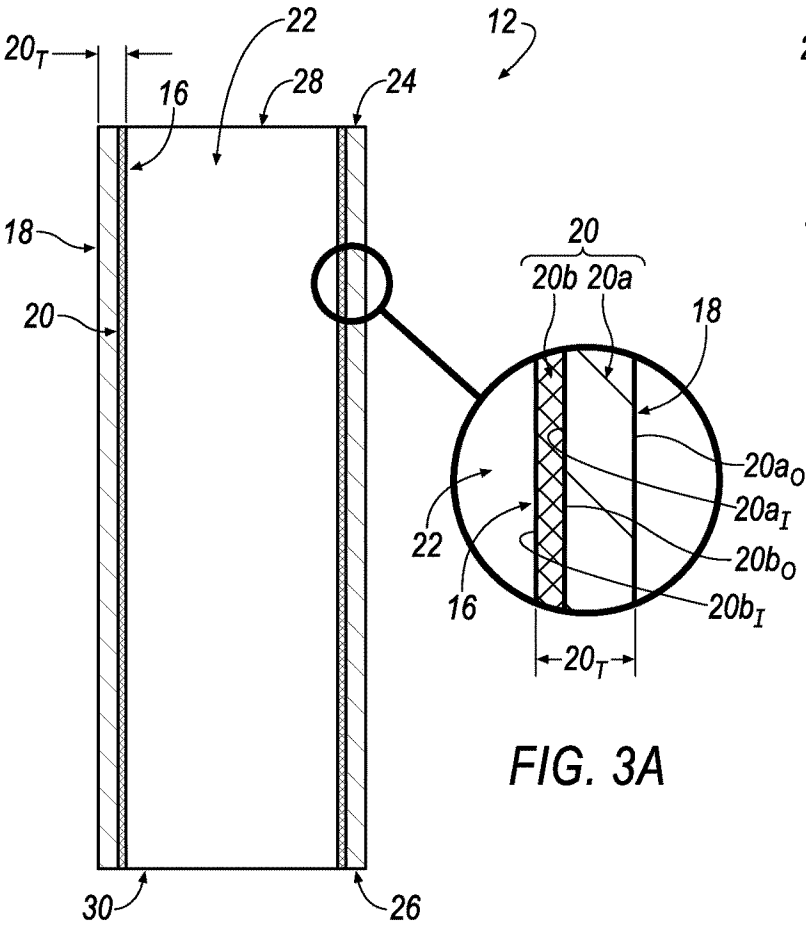
FIG. 2A
FIG. 3A

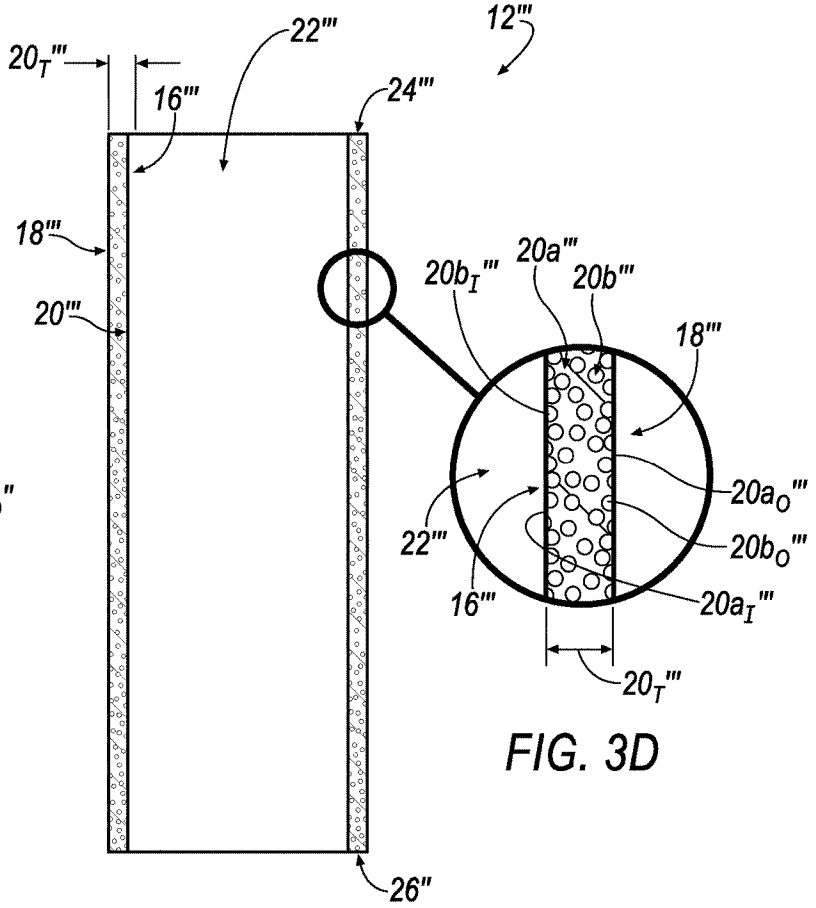
FIG. 2D
FIG. 3D
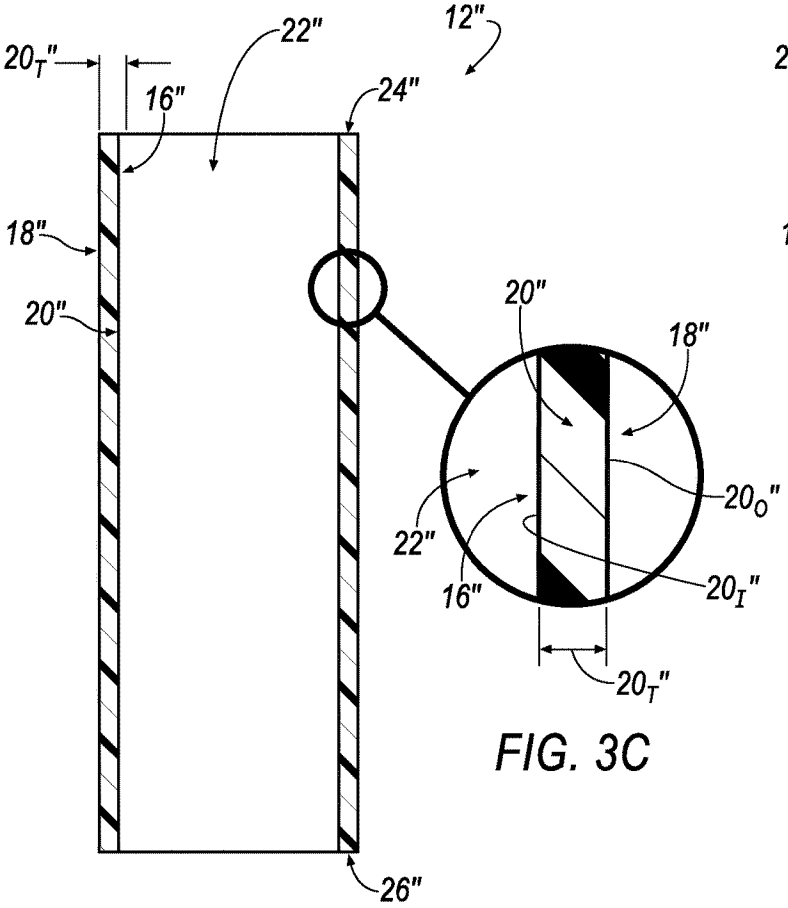
FIG. 2C
FIG. 3C

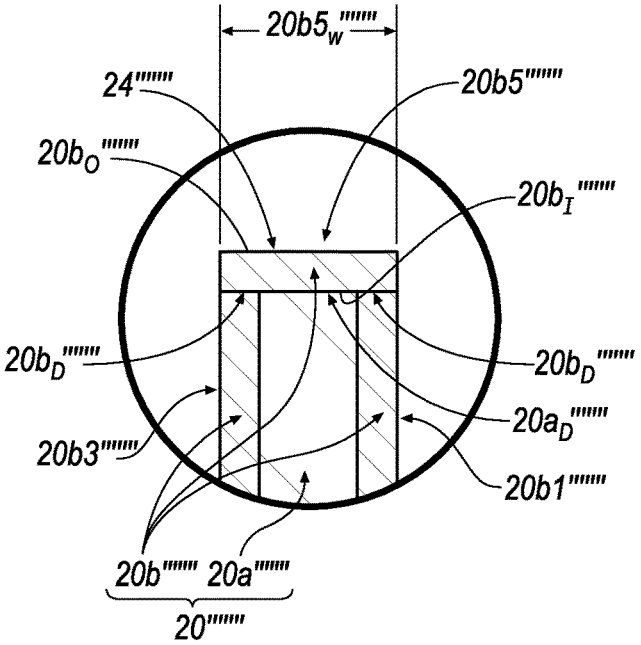
FIG. 8C'
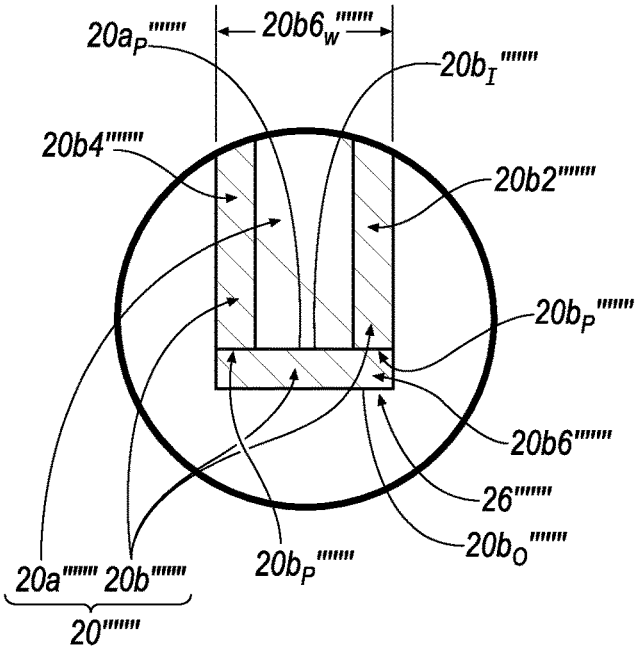
FIG. 8C"

CYLINDRICAL SLEEVE

RELATED APPLICATION

This application is a continuation of U.S. patent application Ser. No. 14/572,273, filed Dec. 16, 2014, which is a continuation-in-part of U.S. patent application Ser. No. 14/175,575, filed Feb. 7, 2014, each of which is expressly incorporated by reference herein.

FIELD OF THE INVENTION

The disclosure relates to a cylindrical sleeve and a method for utilizing the same.

DESCRIPTION OF THE RELATED ART

Improvements to cylindrical sleeves are continuously being sought in order to advance the arts.

SUMMARY

One aspect of the disclosure provides an assembly. The assembly includes a cylindrical sleeve and a length of material. The cylindrical sleeve includes an inner surface and an outer surface. The inner surface of the cylindrical sleeve defines a passage extending through the cylindrical sleeve. The length of material is wound upon itself defining a wound roll. The length of material includes an inner surface and an outer surface. A portion of the inner surface of the length of material forms a passage extending through the wound roll. The outer surface of the cylindrical sleeve is secured to the portion of the inner surface of the length of material that forms the passage extending through the wound roll. The wound roll forms an upper axial end and a lower axial end. The wound roll is defined by a length extending between the upper axial end and the lower axial end. The cylindrical sleeve forms a distal end and a proximal end. The cylindrical sleeve is defined by a length extending between the distal end and the proximal end. The length of the cylindrical sleeve is greater than the length of the wound roll to thereby define a first portion of the length of the cylindrical sleeve that extends beyond the upper axial end of the wound roll and a second portion of the length of the cylindrical sleeve that extends beyond the lower axial end of the wound roll. Both of the first portion of the length of the cylindrical sleeve and the second portion of the length of the cylindrical sleeve are defined by a Sheffield Smoothness that is less than 350.

In some implementations, the cylindrical sleeve is defined by a body. The body is defined by a thickness extending between the inner surface and the outer surface.

In some examples, the thickness is non-constant along the length of the cylindrical sleeve.

In some instances, the body includes two materials defined by: a first material and a second material.

In some implementations, the first material includes a cylindrical body having an inner surface and an outer surface. The second material includes a first cylindrical body having an inner surface and an outer surface. The inner surface of the first cylindrical body defines an upper portion of the inner surface of the cylindrical sleeve. A second cylindrical body includes an inner surface and an outer surface. The inner surface of the second cylindrical body defines a lower portion of the inner surface of the cylindrical sleeve. The outer surface of both of the first cylindrical body and the second cylindrical body formed by the second material are disposed adjacent the inner surface of the cylindrical body formed by the first material. Neither of the first cylindrical body and the second cylindrical body formed by the second material are disposed adjacent a middle portion of the inner surface of the first material such that the middle portion of the inner surface of the first material defines an intermediate portion of the inner surface of the cylindrical sleeve.

In some examples, the outer surface of the first cylindrical body formed by the second material extends along the inner surface of the cylindrical body formed by the first material at a distance approximately equal to the first portion of the length of the cylindrical sleeve that extends beyond the upper axial end of the wound roll.

In some instances, the outer surface of the first cylindrical body formed by the second material extends along the inner surface of the cylindrical body formed by the first material at a distance greater than the first portion of the length of the cylindrical sleeve that extends beyond the upper axial end of the wound roll.

In some implementations, the outer surface of the second cylindrical body formed by the second material extends along the inner surface of the cylindrical body formed by the first material at a distance approximately equal to the second portion of the length of the cylindrical sleeve that extends beyond the lower axial end of the wound roll.

In some examples, the outer surface of the second cylindrical body formed by the second material extends along the inner surface of the cylindrical body formed by the first material at a distance greater than the second portion of the length of the cylindrical sleeve that extends beyond the lower axial end of the wound roll.

In some instances, the second material further includes a third cylindrical body and a fourth cylindrical body. The third cylindrical body has an inner surface and an outer surface. The outer surface of the third cylindrical body defines an upper portion of the outer surface of the cylindrical sleeve. The fourth cylindrical body has an inner surface and an outer surface. The outer surface of the fourth cylindrical body defines a lower portion of the outer surface of the cylindrical sleeve. The inner surface of both of the third cylindrical body and the fourth cylindrical body formed by the second material are disposed adjacent the outer surface of the cylindrical body formed by the first material. Neither of the third cylindrical body and the fourth cylindrical body formed by the second material are disposed adjacent a middle portion of the outer surface of the first material such that the middle portion of the outer surface of the first material defines an intermediate portion of the outer surface of the cylindrical sleeve.

In some implementations, the inner surface of the third cylindrical body formed by the second material extends along the outer surface of the cylindrical body formed by the first material at a distance approximately equal to the first portion of the length of the cylindrical sleeve that extends beyond the upper axial end of the wound roll.

In some examples, the inner surface of the fourth cylindrical body formed by the second material extends along the outer surface of the cylindrical body formed by the first material at a distance approximately equal to the second portion of the length of the cylindrical sleeve that extends beyond the lower axial end of the wound roll.

In some instances, the second material further includes a first annular ring portion and a second annular ring portion. The first annular ring portion has an inner surface and an outer surface. The inner surface of the first annular ring portion is disposed adjacent: a distal end of the cylindrical body formed by the first material and a distal end surface of both of the first cylindrical body portion and the third cylindrical body portion. The second annular ring portion has an inner surface and an outer surface. The inner surface of the second annular ring portion is disposed adjacent: a proximal end of the cylindrical body formed by the first material and a proximal end surface of both of the second cylindrical body portion and the fourth cylindrical body portion.

In some implementations, the first annular ring portion is defined by a width dimension that is approximately equal to a combined thickness of: the cylindrical sleeve, the first cylindrical body portion and the third cylindrical body portion. The second annular ring portion is defined by a width dimension that is approximately equal to a combined thickness of: the cylindrical sleeve, the second cylindrical body portion and the fourth cylindrical body portion.

In some examples, the Sheffield Smoothness is approximately equal to 250.

In some instances, the second material is a paper liner that includes velvet.

In some instances, the second material is bleached board material.

In some implementations, the second material is a plastic liner.

In some examples, the second material is a plastic coating.

In some instances, the first material has a Sheffield Smoothness that is greater than 350.

In some implementations, the first material is a rough, cardboard-based paper material.

In some examples, the length of material is a length of wrapping film.

In some instances, the passage extends through the cylindrical sleeve between the distal end of the cylindrical sleeve and a proximal end of the cylindrical sleeve. Access to the passage is permitted by a distal opening formed in the distal end of the cylindrical sleeve and a proximal opening formed in the proximal end of the cylindrical sleeve.

In some implementations, the outer surface of the cylindrical sleeve meets each of the distal end and the proximal end of the cylindrical sleeve to respectively define a tapered corner.

In some implementations, both of the inner surface and the outer surface of the cylindrical sleeve meet each of the distal end and the proximal end of the cylindrical sleeve to respectively define tapered corners.

Another aspect of the disclosure provides a method including a step of without arranging an axial insert disposed within a passage extending through a cylindrical sleeve, arranging an operators hands directly adjacent one or more of: an inner surface, an outer surface, a distal end and a proximal end of the cylindrical sleeve defined by: (1) a first portion of a length of the cylindrical sleeve that extends beyond an upper axial end of a wound roll and (2) a second portion of the length of the cylindrical sleeve that extends beyond a lower axial end of the wound roll. One or more of: the inner surface, the outer surface, the distal end and the proximal end of the cylindrical sleeve defined by the first portion of the length of the cylindrical sleeve and the second portion of the length of the cylindrical sleeve is defined by the Sheffield Smoothness that is less than 350. The method also includes the step of spinning the wound roll about an axis of rotation extending through the passage extending through the cylindrical sleeve for dispensing the length of material from the wound roll.

BRIEF DESCRIPTIONS OF THE DRAWINGS

The detailed description particularly refers to the accompanying figures in which:

FIG. 2A is a cross-sectional view of the cylindrical sleeve according to line 2-2 of FIG. 1A.

FIG. 2B is a cross-sectional view of the cylindrical sleeve according to line 2-2 of FIG. 1A.

FIG. 2C is a cross-sectional view of the cylindrical sleeve according to line 2-2 of FIG. 1A.

FIG. 2D is a cross-sectional view of the cylindrical sleeve according to line 2-2 of FIG. 1A.

FIG. 3A is an enlarged view of the cylindrical sleeve of FIG. 2A.

FIG. 3B is an enlarged view of the cylindrical sleeve of FIG. 2B.

FIG. 3C is an enlarged view of the cylindrical sleeve of FIG. 2C.

FIG. 3D is an enlarged view of the cylindrical sleeve of FIG. 2D.

Figures 7A, 8A:
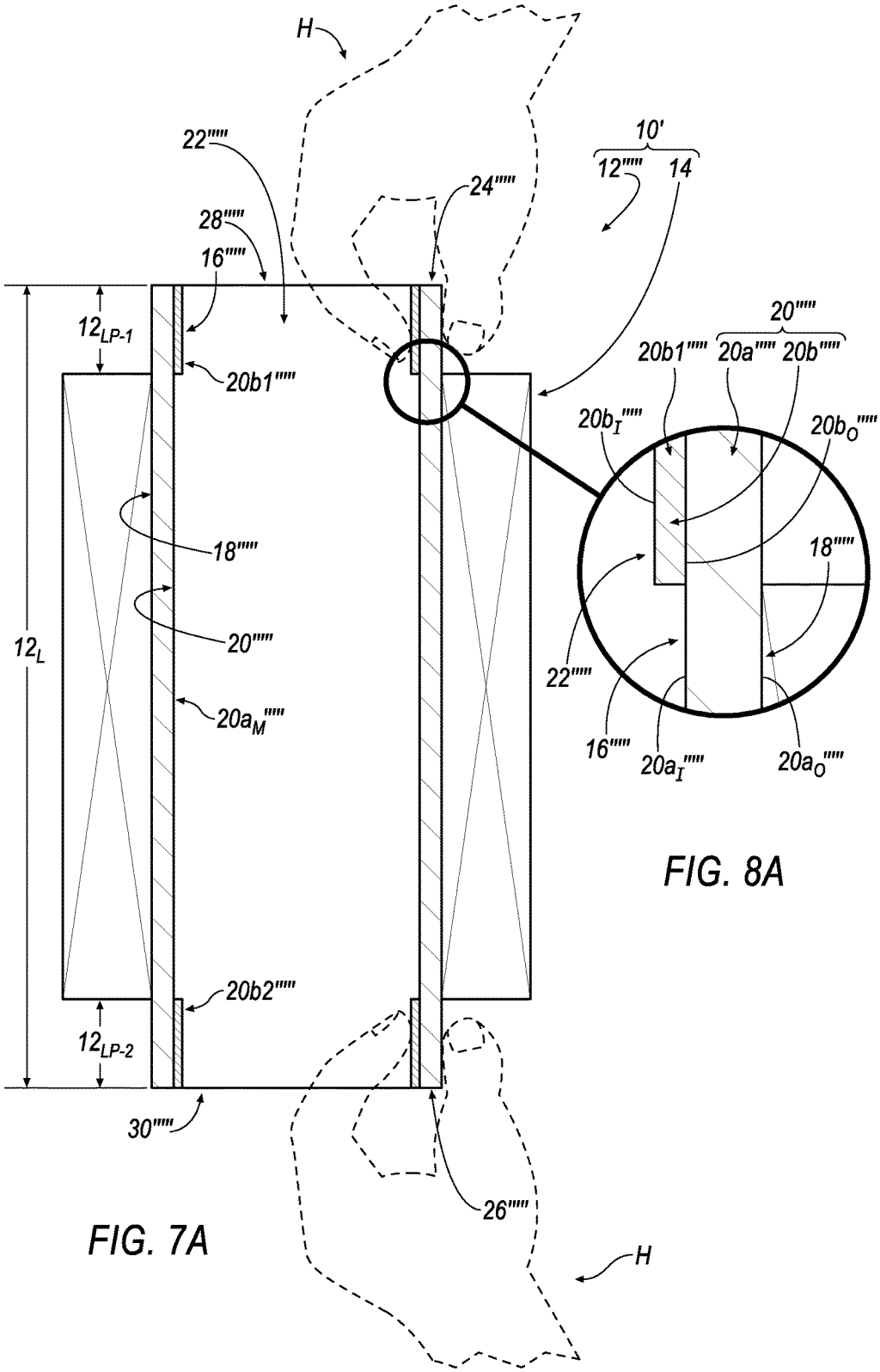
FIG. 7A is a cross-sectional view of the cylindrical sleeve according to line 7-7 of FIG. 6B.
FIG. 8A is an enlarged view of the cylindrical sleeve of FIG. 7A.
Figures 7B, 8B:
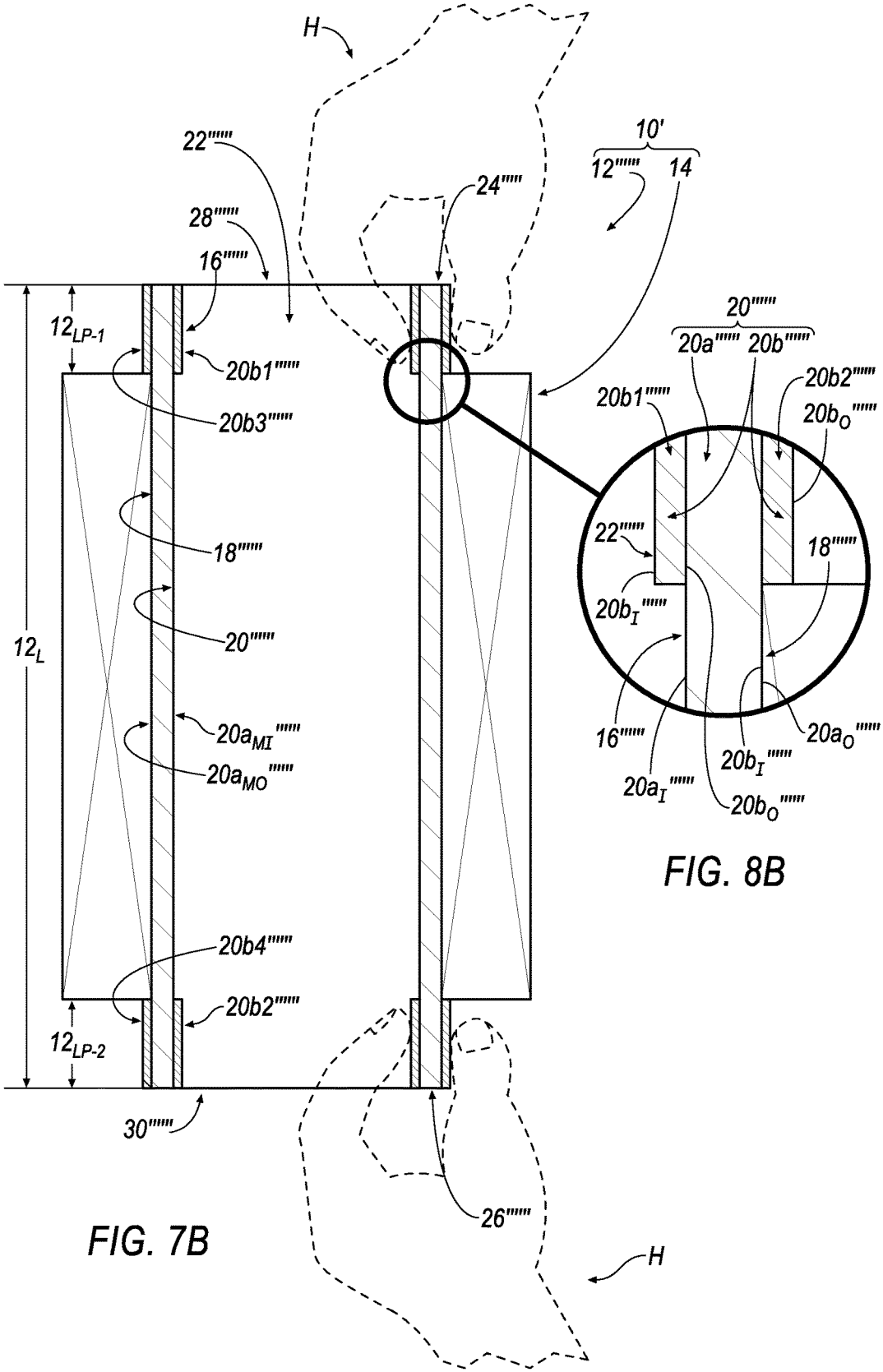
FIG. 7B is a cross-sectional view of the cylindrical sleeve according to line 7-7 of FIG. 6B.
FIG. 8B is an enlarged view of the cylindrical sleeve of FIG. 7B.
Figures 7C, 8C:
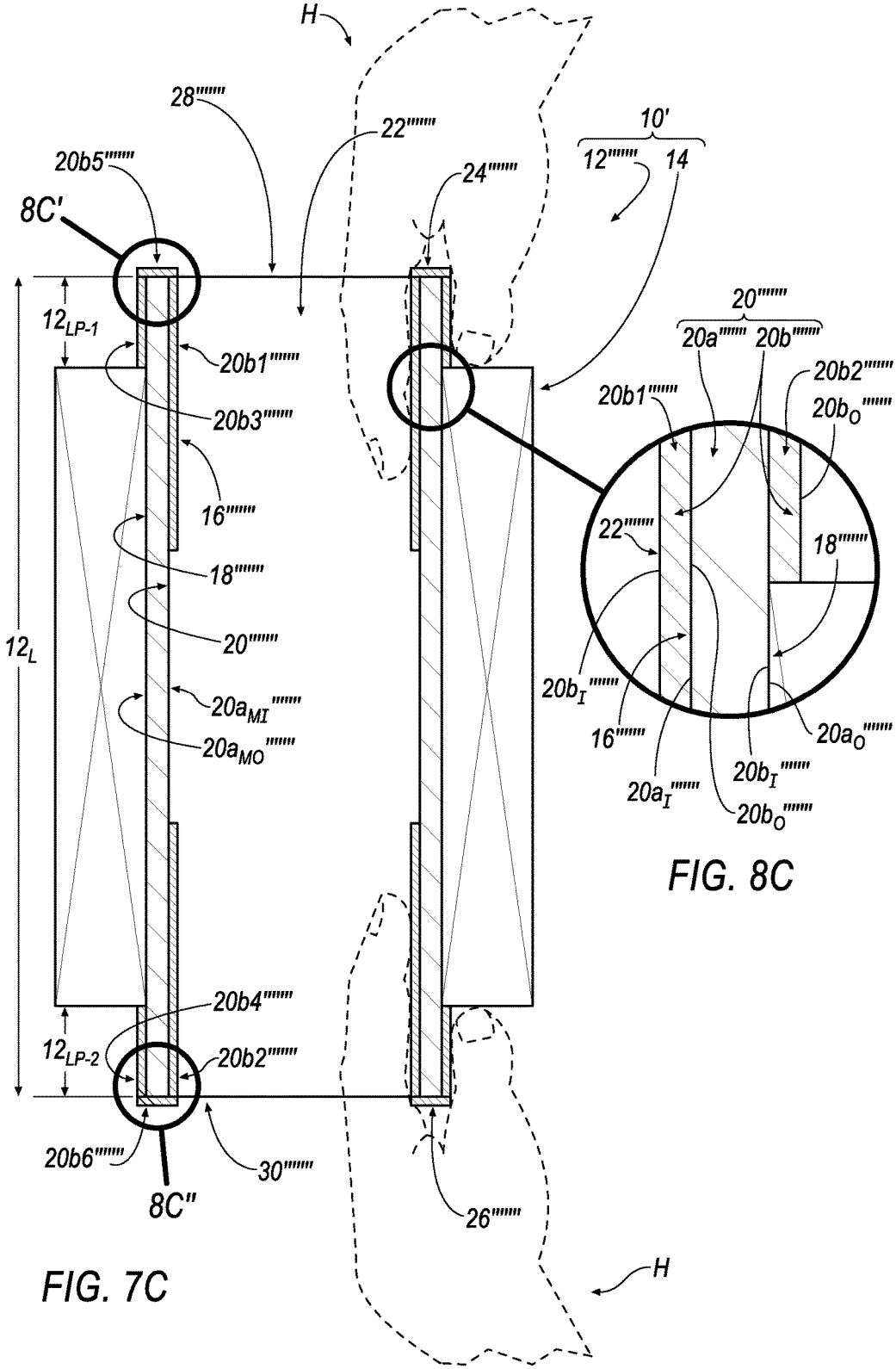
FIG. 7C is a cross-sectional view of the cylindrical sleeve according to line 7-7 of FIG. 6B.
FIG. 8C is a first enlarged view of the cylindrical sleeve of FIG. 7C.

FIG. 8C' is a second enlarged view of the cylindrical sleeve of FIG. 7C.

FIG. 8C" is a third enlarged view of the cylindrical sleeve of FIG. 7C.

Figure 6A:
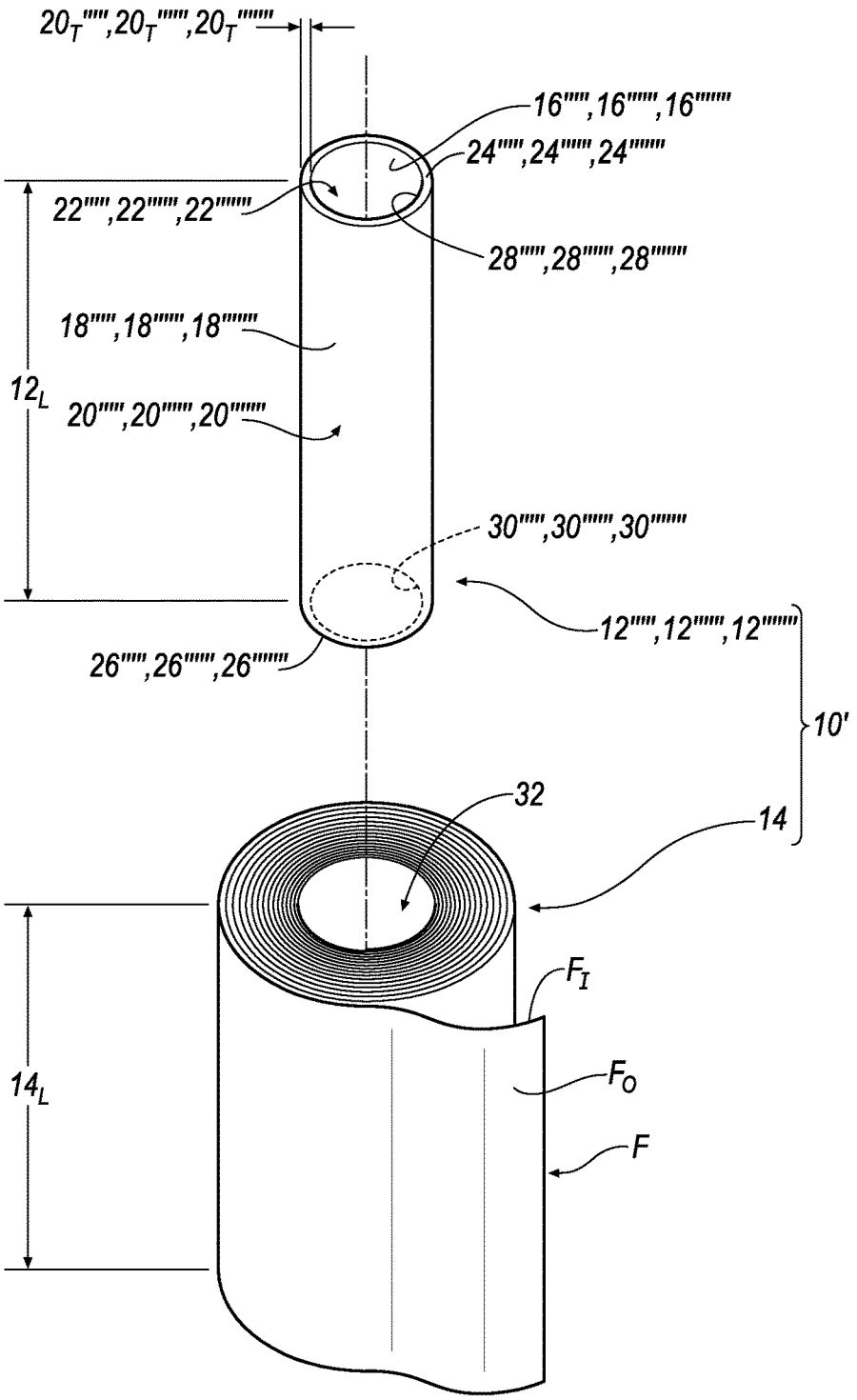
FIG. 6A is an exploded perspective view of an assembly including a cylindrical sleeve in accordance with an exemplary embodiment of the invention.
Figure 6B:
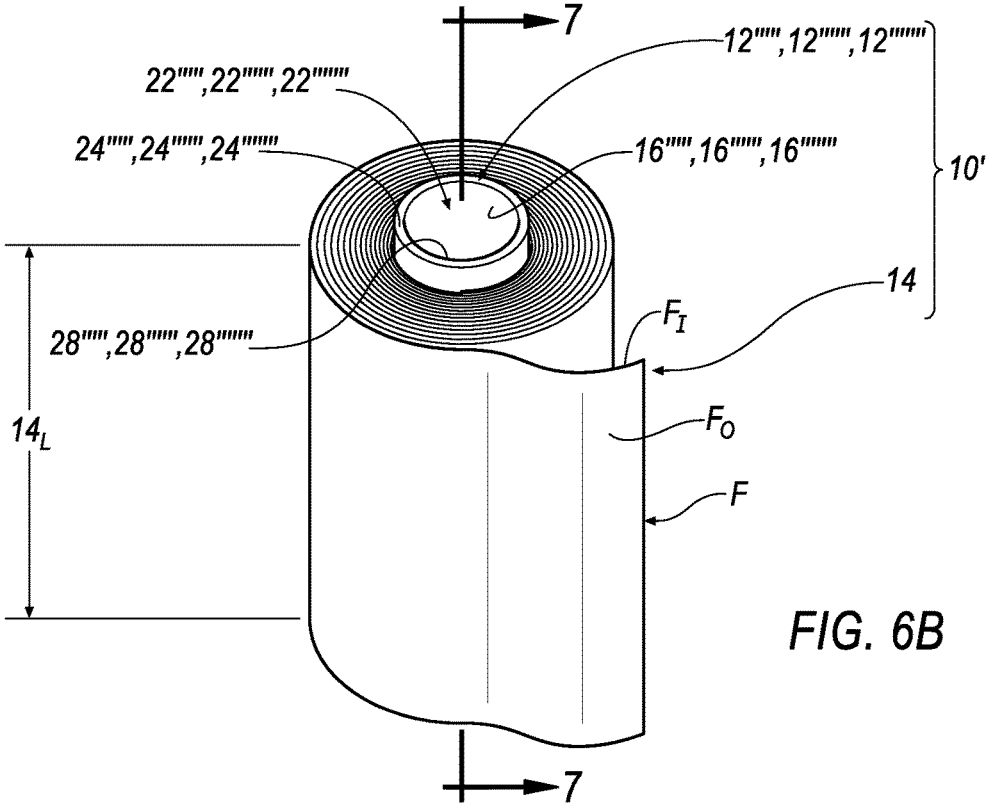
FIG. 6B is an assembled perspective view of the assembly of FIG. 6A.
Figure 6C:
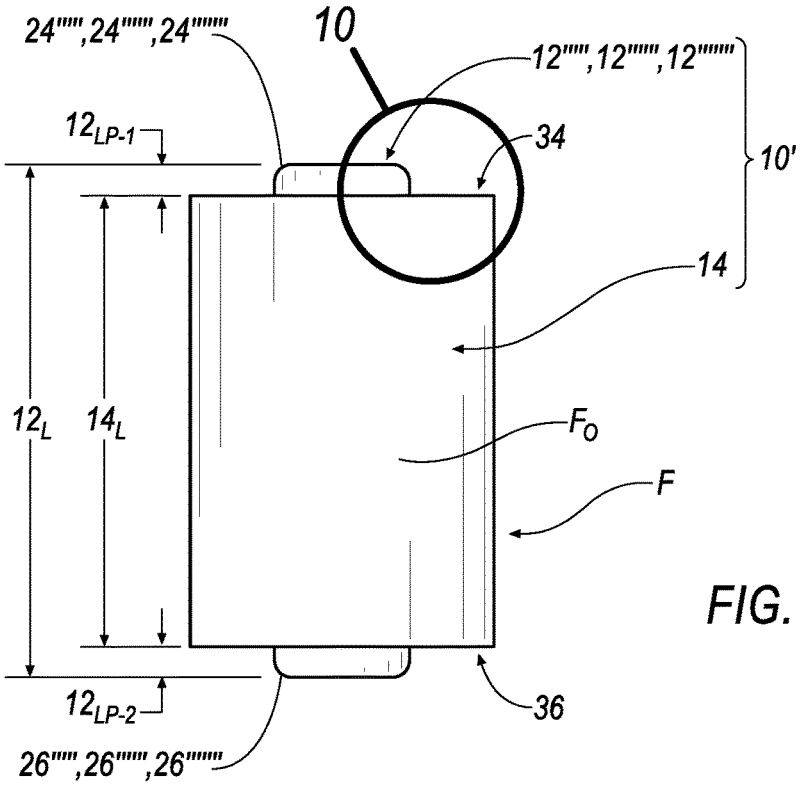
FIG. 6C is a side view of the assembly of FIG. 6B.
Figure 9:
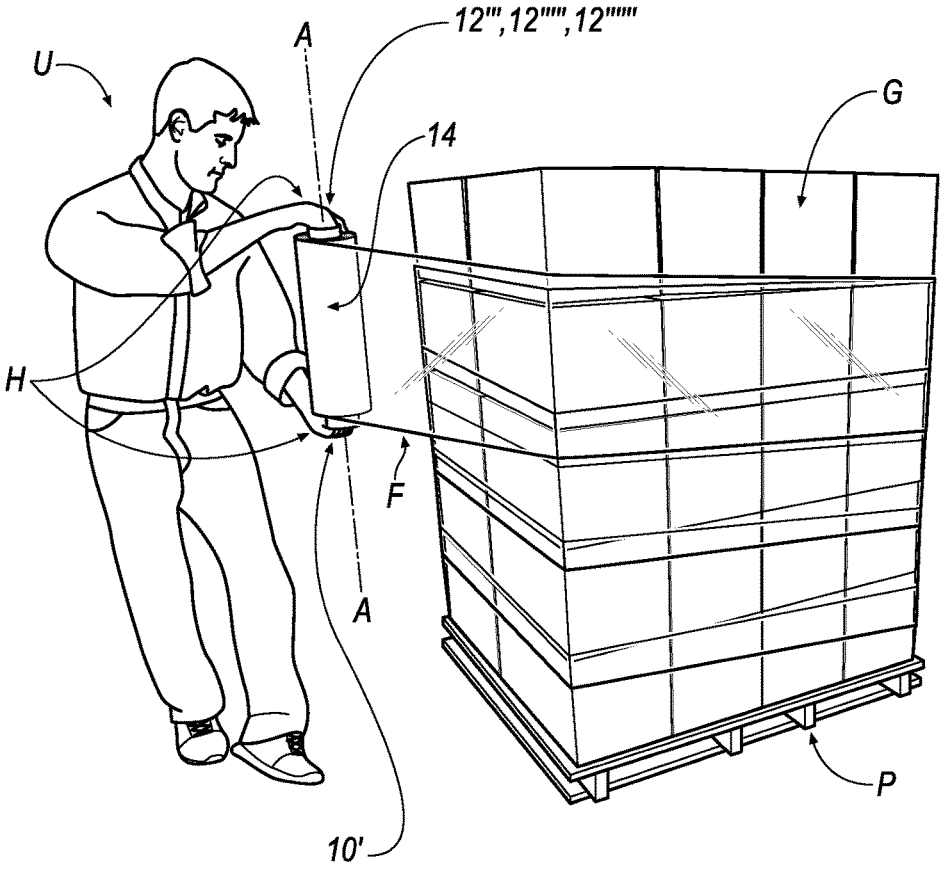

FIG. 9 is a view of a method for utilizing the assembly including the cylindrical sleeve of FIGS. 6A-6C.

Figure 10:
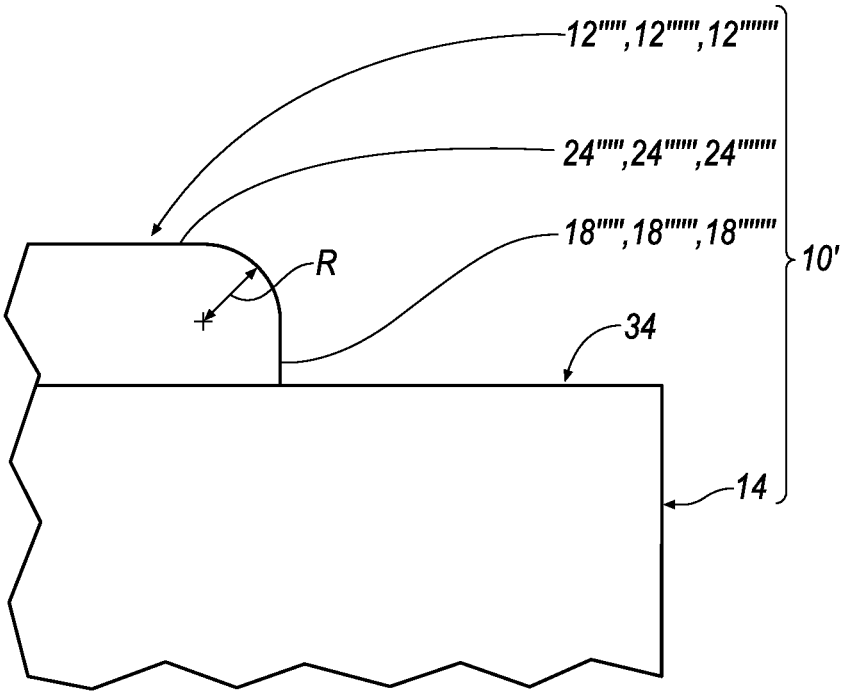

FIG. 10 is an enlarged view of the cylindrical sleeve of FIG. 6C.

Figure 11A:
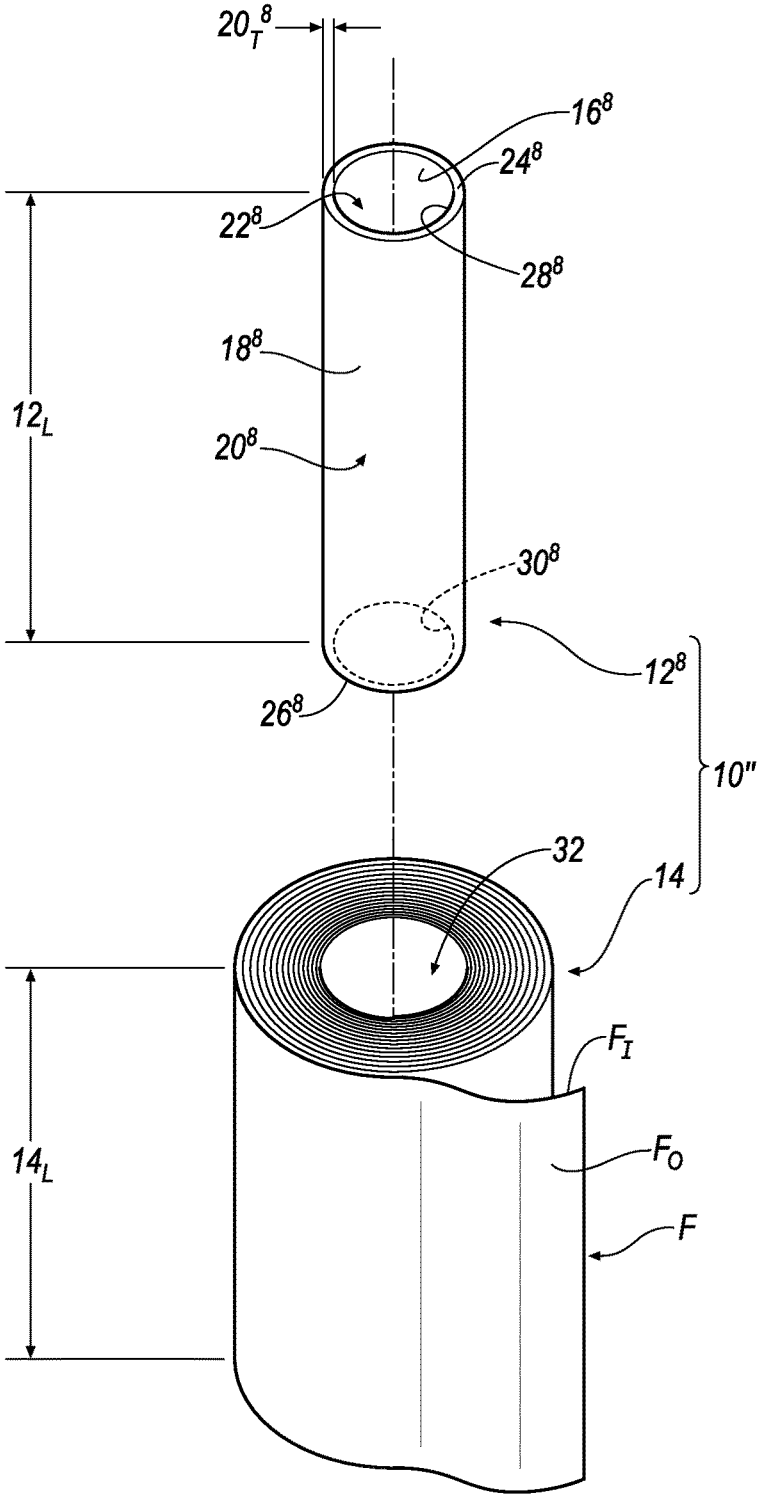

FIG. 11A is an exploded perspective view of an assembly including a cylindrical sleeve in accordance with an exemplary embodiment of the invention.

Figure 11B:
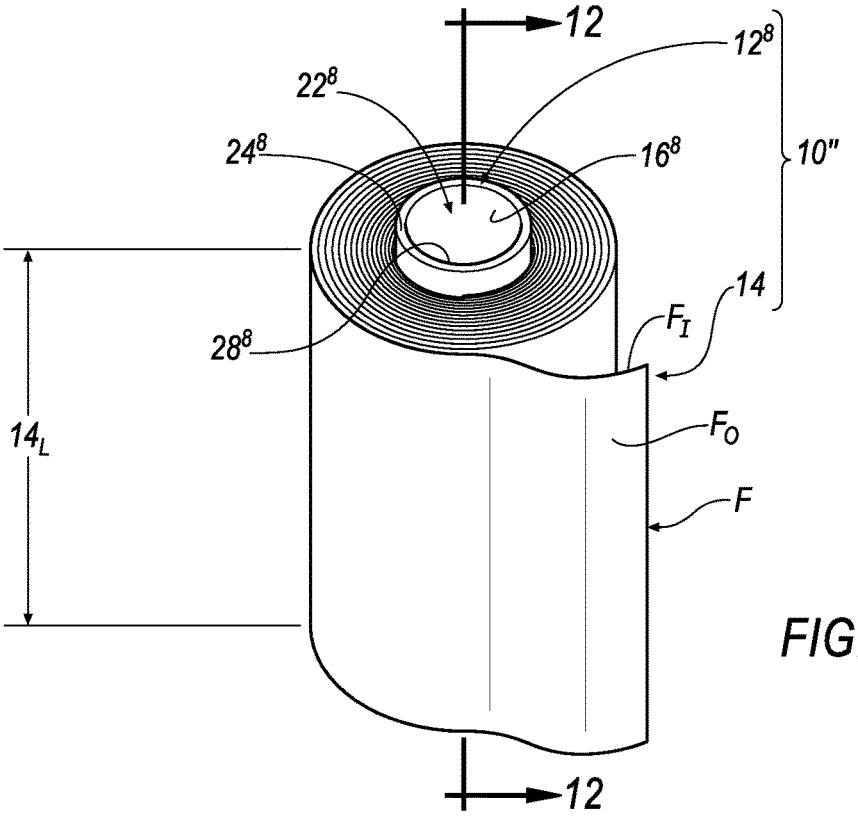

FIG. 11B is an assembled perspective view of the assembly of FIG. 11A.

Figure 11C:
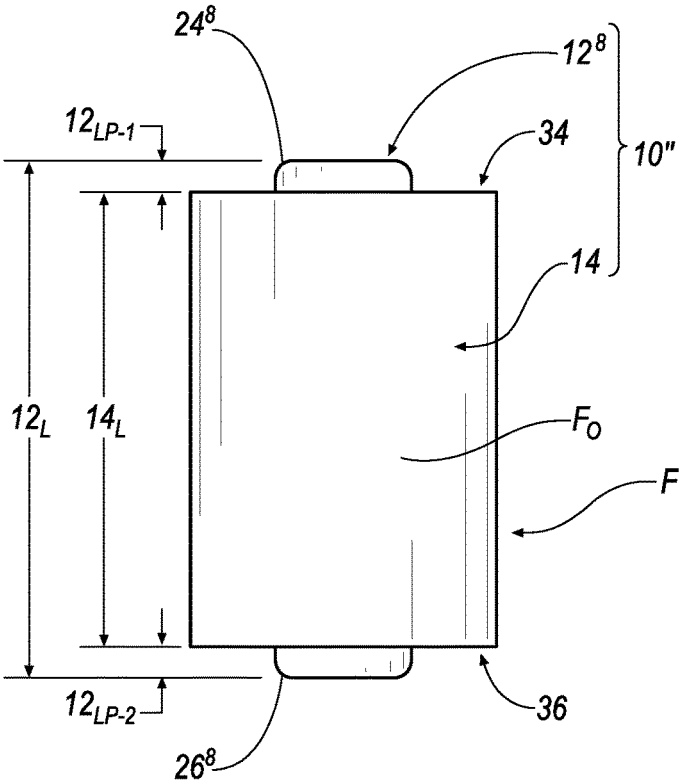

FIG. 11C is a side view of the assembly of FIG. 11B.

Figures 12A, 13A:
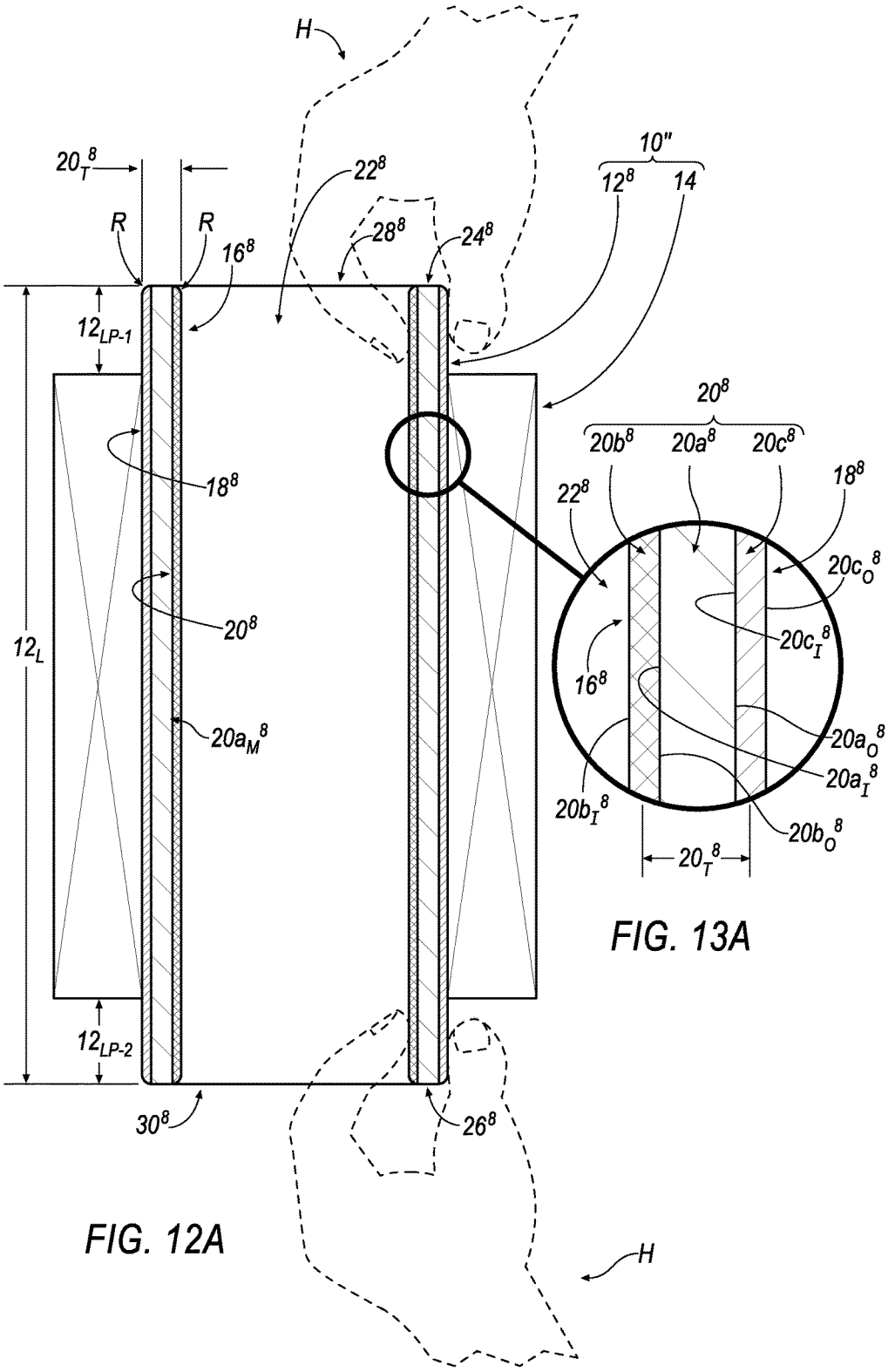

FIG. 12A is a cross-sectional view of the cylindrical sleeve according to line 12-12 of FIG. 11B.

FIG. 13A is an enlarged view of the cylindrical sleeve of FIG. 12A.

Figure 14:
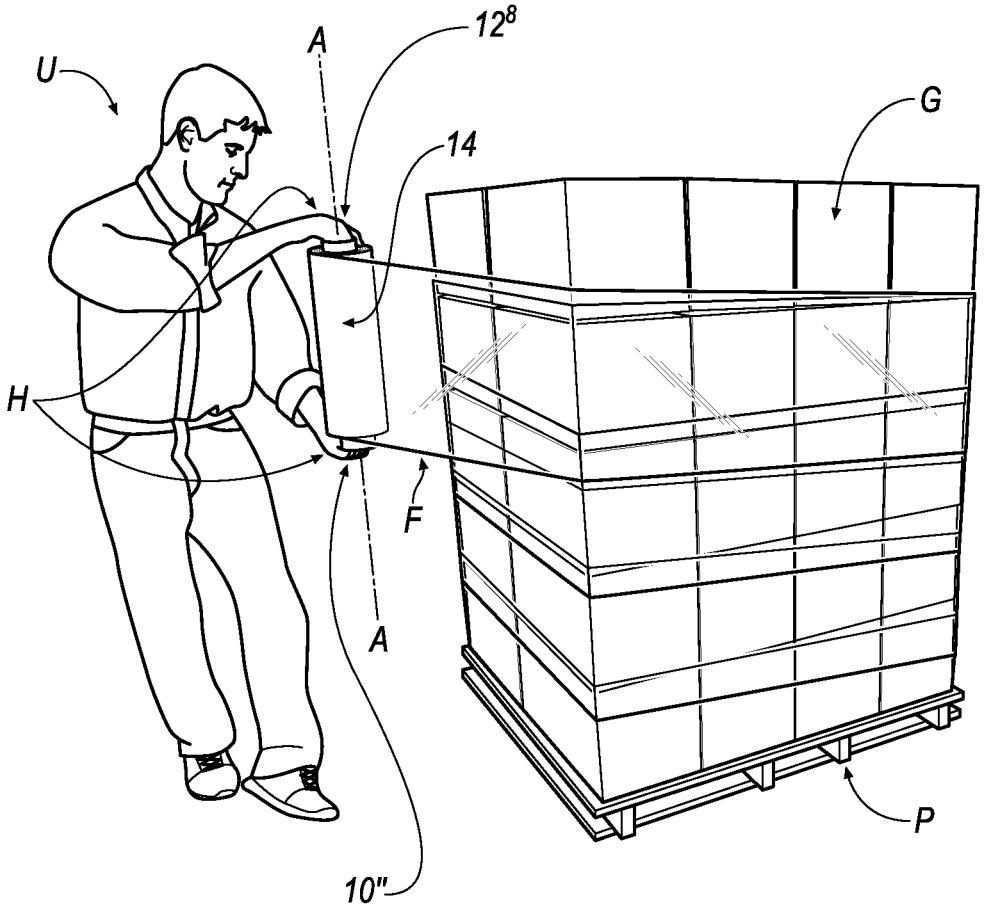

FIG. 14 is a view of a method for utilizing the assembly including the cylindrical sleeve of FIGS. 11A-11C.

DETAILED DESCRIPTION

The Figures illustrate exemplary embodiments of a cylindrical sleeve and a method for utilizing the same. Based on the foregoing, it is to be generally understood that the nomenclature used herein is simply for convenience and the terms used to describe the invention should be given the broadest meaning by one of ordinary skill in the art.

Figure 1A:
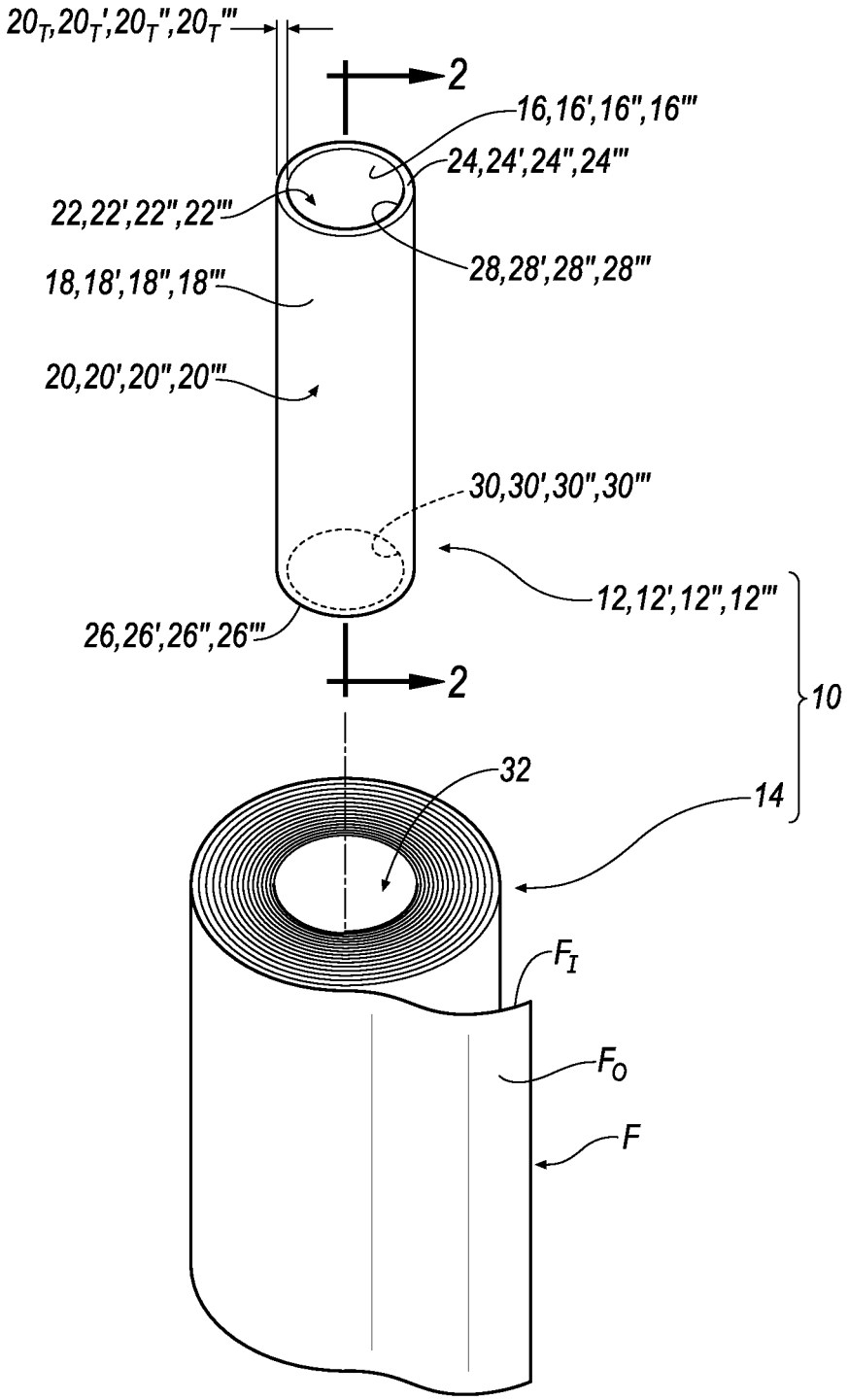
FIG. 1A is an exploded perspective view of an assembly including a cylindrical sleeve in accordance with an exemplary embodiment of the invention.
Figure 1B:
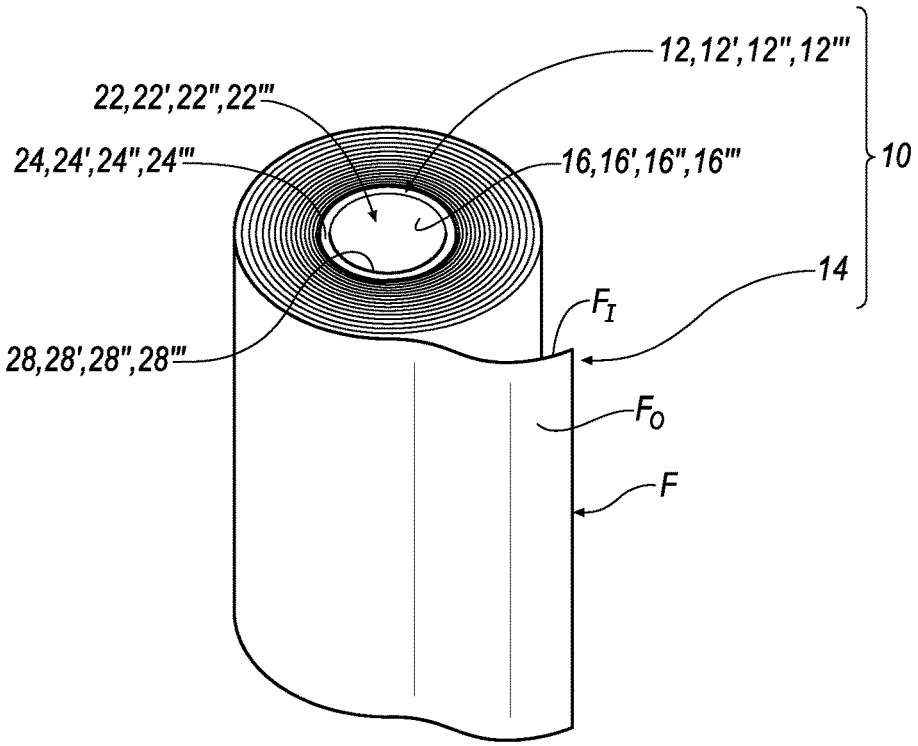
FIG. 1B is an assembled perspective view of the assembly of FIG. 1A.
Figures 2E, 3E:
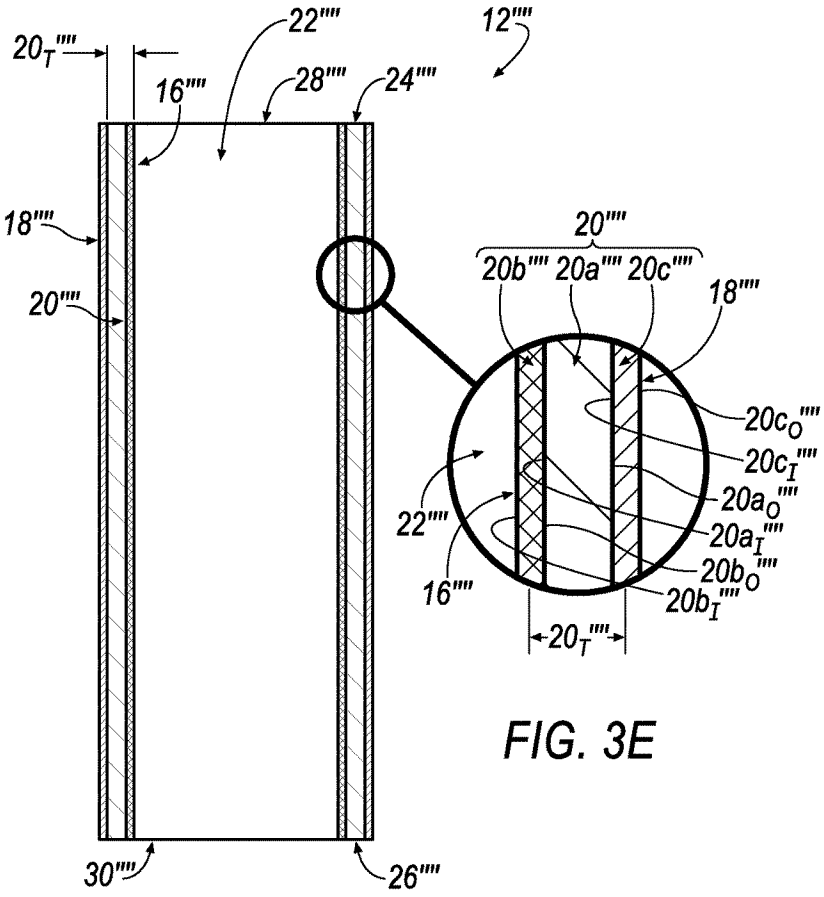
FIG. 2E is a cross-sectional view of the cylindrical sleeve according to line 2-2 of FIG. 1A.
FIG. 3E is an enlarged view of the cylindrical sleeve of FIG. 2E.

Referring to FIGS. 1A-1B, an assembly is shown generally at 10. The assembly 10 includes a cylindrical sleeve 12 (see, e.g., FIGS. 2A and 3A), 12' (see, e.g., FIGS. 2B and 3B), 12" (see, e.g., FIGS. 2C and 3C) or 12'" (see, e.g., FIGS. 2D and 3D) and a wound roll 14. A length of material, F, that is wound upon itself may define the wound roll 14.

Figure 4:
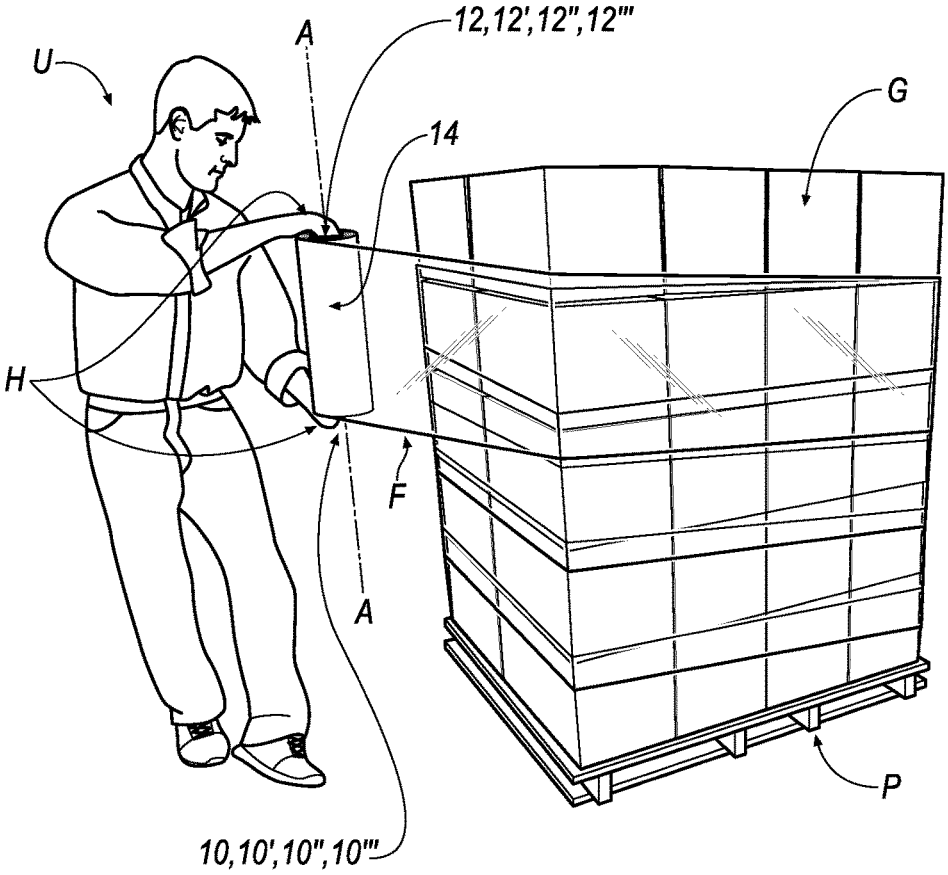
FIG. 4 is a view of a method for utilizing the assembly including the cylindrical sleeve of FIG. 1A-1B or 5A-5C.

In some implementations, the length of material, F, may be a length of wrapping film. As seen in FIG. 4, the length of wrapping film, F, may be dispensed unwound from the wound roll 14 by a user, U, such that the length of wrapping film, F, may be disposed about and wrap a plurality of goods, G, that are arranged upon a pallet, P. Although some implementations of the length of material, F, may include a length of wrapping film, the length of material, F, may not be limited to including a length of wrapping film, and may alternatively include, for example, a length of paper, a length of tin foil or the like.

Referring back to FIGS. 1A-1B, the cylindrical sleeve 12, 12', 12", 12'" may include an inner surface 16, 16', 16", 16' and an outer surface 18, 18', 18", 18'". The cylindrical sleeve 12, 12', 12", 12'" is defined by a body 20, 20', 20", 20' of one or more materials (e.g., one material as seen in FIGS. 2C and 3C, or, alternatively, a first material 20 *a* (see, e.g., FIGS. 2A and 3A), 20 *a'* (see, e.g., FIGS. 2B and 3B), 20 *a'"* (see, e.g., FIGS. 2D and 3D) and a second material 20 *b* (see, e.g., FIGS. 2A and 3A), 20*b'* (see, e.g., FIGS. 2B and 3B), 20 *b'"* (see, e.g., FIGS. 2D and 3D)). The body 20, 20', 20", 20' is defined by a thickness, $\mathbf{20}_T$, $\mathbf{20}_T'$, $\mathbf{20}_T''$, $\mathbf{20}_T''$, $\mathbf{20}_T'''$ extending between the inner surface 16, 16', 16", 16'" and the outer surface 18, 18', 18", 18'".

The inner surface 16, 16', 16", 16'" defines a passage 22, 22', 22", 22'" extending through the cylindrical sleeve 12, 12', 12", 12'" between a distal end 24, 24', 24", 24' of the cylindrical sleeve 12, 12', 12", 12'" and a proximal end 26, 26', 26", 26'" of the cylindrical sleeve 12, 12', 12", 12'". Access to the passage 22, 22', 22", 22'" is permitted by a distal opening 28, 28', 28", 28' formed in the distal end 24, 24', 24", 24' of the cylindrical sleeve 12, 12', 12", 12'" and a proximal opening 30, 30', 30", 30'" formed in the proximal end 26, 26', 26", 26'" of the cylindrical sleeve 12, 12', 12", 12'".

The length of material, F, includes an inner surface, $F_I$, and an outer surface, $F_O$. A portion of the inner surface, $F_I$, of the length of material, F, forms a passage 32 extending through the wound roll 14. The outer surface 18, 18', 18", 18'" of the cylindrical sleeve 12, 12', 12", 12'" may be secured to the portion of the inner surface, $F_I$, of the length of material, F, that forms the passage 32 extending through the wound roll 14. In some implementations, an adhesive (not shown) may be disposed over one or both of the outer surface 18, 18', 18", 18' of the cylindrical sleeve 12, 12', 12", 12'" and the portion of the inner surface, $F_I$, of the length of material, F, that forms the passage 32 extending through the wound roll 14 for securing the cylindrical sleeve 12, 12', 12", 12'" to the wound roll 14.

Referring to FIGS. 2A and 3A, the exemplary cylindrical sleeve 12 is shown. Referring to FIG. 3A, the body 20 defining the cylindrical sleeve 12 includes at least a first material 20*a* and a second material 20*b*.

The first material 20*a* may include a cylindrical body having an inner surface $\mathbf{20}a_I$ and an outer surface $\mathbf{20}a_O$. The outer surface $\mathbf{20}a_O$ of the first material 20*a* may define the outer surface 18 of the cylindrical sleeve 12. The second material 20*b* may include a cylindrical body having an inner surface $\mathbf{20}b_I$ and an outer surface $\mathbf{20}b_O$. The inner surface $\mathbf{20}b_I$ of the second material 20*b* may define the inner surface 16 of the cylindrical sleeve 12. The inner surface $\mathbf{20}a_I$ of the first material 20*a* is disposed adjacent the outer surface $\mathbf{20}b_O$ of the second material 20*b*.

In some implementations, the second material 20*b* is a liner that is disposed over the inner surface $\mathbf{20}a_I$ of the first material 20*a*. In some examples, the outer surface $\mathbf{20}b_O$ of the second material 20*b* is secured to the inner surface $\mathbf{20}a_I$ of the first material 20*a* by an adhesive (not shown).

In some implementations, the first material 20*a* may include a rough, cardboard-based paper material that includes, but is not limited to a new virgin paper material or a recycled paper material. In some examples, the second material 20*b* may include a paper material (e.g., a paper lining including a plush characteristic, such as velvet). In some instances, the second material 20*b* may include a non-paper material (e.g., a plastic lining). Although the first material 20*a* of FIG. 2A, which may include a rough, cardboard-based paper material, is shown including one layer of material, the first material 20*a* is not limited to including one layer of material; accordingly, in some instances, the first material 20*a*, which may include a rough, cardboard-based paper material, may include a plurality of layers of material. In some examples, a multi-layer first material 20*a* may be formed by winding a strip of rough, cardboard-based paper material (e.g., Brown Kraft paper, which may alternatively be referred to as recycled paper) on a mandrel in a spiral with edges of the rough, cardboard-based paper material arranged adjacent one another forming a spiral seam; subsequently, one or more second strips of rough, cardboard-based paper material may be wound over the first rough, cardboard-based paper material arranged upon the mandrel until the first material 20*a* is formed to include a desired thickness. In some instances, if, for example, the rough, cardboard-based paper material paper is 0.025" thick, and, a desired thickness of the first material 20*a* is 0.25", ten strips of rough, cardboard-based paper material may be utilized as described above for forming the first material 20*a*.

Comparatively, a Sheffield Smoothness (SS) of the second material 20*b* is lower than a SS of the first material 20*a*; in some implementations, the first material 20*a* may be defined by a SS greater than 350 (e.g., a SS that is approximately equal to 370). In some implementations, the second material 20*b* may be defined by a SS that is less than 350; in an exemplary embodiment, the second material 20*b* may be defined by a SS approximately equal to 250.

As a result of the SS of the second material 20*b* being less than the SS of the first material 20*a*, the inner surface $\mathbf{20}b_I$ of the second material 20*b* is defined by a SS that is less than a SS of the inner surface $\mathbf{20}a_I$ of the first material 20*a*. Therefore, because the inner surface $\mathbf{20}b_I$ of the second material 20*b* defines the inner surface 16 of the cylindrical sleeve 12, the inner surface 16 of the cylindrical sleeve 12 includes a lower SS than, for example a rough, cardboard-based paper material.

Although FIGS. 2A-3A show a first material 20*a* and a second material 20*b*, the cylindrical sleeve 12 is not limited to a first material 20*a* and a second material 20*b*. For example a cylindrical sleeve 12"" (see, e.g., FIGS. 2E and 3E) may include a first material (see, e.g., 20*a*"" in FIG. 3E), a second material (see, e.g., 20' in FIG. 3E) and a third material (see, e.g., 20*c*"" in FIG. 3E). The third material 20*c*"" may be arranged over and adjacent the outer surface $\mathbf{20}a_O$"" of the first material 20*a*"". A Sheffield Smoothness (SS) of the third material 20*c*"" is lower than a SS of the first material 20*a*""; in some implementations, the first material 20*a*"" may be defined by a SS greater than 350 (e.g., a SS that is approximately equal to 370). In some implementations, the second and third materials 20*b*"", 20*c*"" may be defined by a SS that is less than 350; in an exemplary embodiment, the second and third materials 20*b*"", 20*c*"" may be defined by a SS approximately equal to 250.

Referring to FIGS. 2B and 3B, the exemplary cylindrical sleeve 12' is shown. The body 20' defining the cylindrical sleeve 12' includes at least a first material 20*a*' and a second material 20*b*'.

The first material 20*a*' may include a cylindrical body having an inner surface $\mathbf{20}a_I$' and an outer surface $\mathbf{20}a_O$'. The outer surface $\mathbf{20}a_O$' of the first material 20*a*' may define the outer surface 18' of the cylindrical sleeve 12'. The second material 20*b*' may include a cylindrical body having an inner surface $\mathbf{20}b_I$' and an outer surface $\mathbf{20}b_O$'. The inner surface $\mathbf{20}b_I$' of the second material 20*b*' may define the inner surface 16' of the cylindrical sleeve 12'. The inner surface $\mathbf{20}a_I$' of the first material 20*a*' is disposed adjacent the outer surface $\mathbf{20}b_O$' of the second material 20*b*'.

In some implementations, the second material 20*b*' is a coating that is disposed over the inner surface $\mathbf{20}a_I$' of the first material 20*a*'. If the second material 20*b*' is a coating, in some instances, at the time the second material 20*b*' is applied (e.g., extruded, lapped, painted or the like) to the first material 20*a*', the outer surface $\mathbf{20}b_O$' of the second material 20*b*' may include a tacky, adhesive quality that permits the outer surface $\mathbf{20}b_O$' of the second material 20*b*' to bond to the inner surface $\mathbf{20}a_I$' of the first material 20*a*' without the use of a binding agent (e.g., such as, for example, an adhesive). Once the second material 20*b*' has cured, the tacky, adhesive quality of the second material 20*b*' may define a smooth, non-tacky, non-adhesive quality.

In some implementations, the first material 20*a*' may include a rough, cardboard-based paper material that includes, but is not limited to a new virgin paper material or a recycled paper material. In some instances, the second material 20*b*' may include a non-paper material (e.g., a plastic coating). Although the first material 20*a*' of FIG. 2B, which may include a rough, cardboard-based paper material, is shown including one layer of material, the first material 20*a*' is not limited to including one layer of material; accordingly, in some instances, the first material 20*a*', which may include a rough, cardboard-based paper material, may include a plurality of layers of material. In some examples, a multi-layer first material 20*a*' may be formed by winding a strip of rough, cardboard-based paper material (e.g., Brown Kraft paper, which may alternatively be referred to as recycled paper) on a mandrel in a spiral with edges of the rough, cardboard-based paper material arranged adjacent one another forming a spiral seam; subsequently, one or more second strips of rough, cardboard-based paper material may be wound over the first rough, cardboard-based paper material arranged upon the mandrel until the first material 20*a*' is formed to include a desired thickness. In some instances, if, for example, the rough, cardboard-based paper material paper is 0.025" thick, and, a desired thickness of the first material 20*a*' is 0.25", ten strips of rough, cardboard-based paper material may be utilized as described above for forming the first material 20*a*'.

Comparatively, a Sheffield Smoothness (SS) of the second material 20*b*' is lower than a SS of the first material 20*a*'; in some implementations, the first material 20*a*' may be defined by a SS greater than 350 (e.g., a SS that is approximately equal to 370). In some implementations, the second material 20*b*' may be defined by a SS that is less than 350; in an exemplary embodiment, the second material 20*b*' may be defined by a SS approximately equal to 250.

As a result of the SS of the second material 20*b*' being less than the SS of the first material 20*a*', the inner surface $\mathbf{20}b_I$' of the second material 20*b*' is defined by a SS that is less than a SS of the inner surface $\mathbf{20}a_I$' of the first material 20*a*'. Therefore, because the inner surface $\mathbf{20}b_I$' of the second material 20*b*' defines the inner surface 16' of the cylindrical sleeve 12', the inner surface 16' of the cylindrical sleeve 12' includes a lower SS than, for example a rough, cardboard-based paper material.

Although FIGS. 2B-3B show a first material 20*a*' and a second material 20*b*', the cylindrical sleeve 12' is not limited to a first material 20*a*' and a second material 20*b*'. For example a cylindrical sleeve 12"" (see, e.g., FIGS. 2E and 3E) may include a first material (see, e.g., 20*a*"" in FIG. 3E), a second material (see, e.g., 20"" in FIG. 3E) and a third material (see, e.g., 20*c*"" in FIG. 3E). The third material 20*c*"" may be arranged over and adjacent the outer surface $\mathbf{20}a_O$"" of the first material 20*a*"". A Sheffield Smoothness (SS) of the third material 20*c*"" is lower than a SS of the first material 20*a*""; in some implementations, the first material 20*a*"" may be defined by a SS greater than 350 (e.g., a SS that is approximately equal to 370). In some implementations, the second and third materials 20*b*"", 20*c*"" may be defined by a SS that is less than 350; in an exemplary embodiment, the second and third materials 20*b*"", 20*c*"" may be defined by a SS approximately equal to 250.

Referring to FIGS. 2C and 3C, the exemplary cylindrical sleeve 12" is shown. Unlike the exemplary cylindrical sleeves 12, 12' described above, the body 20" of the exemplary cylindrical sleeve 12" does not include two materials (e.g., 20*a*, 20*b* as seen in FIG. 3A or 20*a*', 20*b*' as seen in FIG. 3B), but, rather, one material. The body 20" may include a cylindrical body having an outer surface $\mathbf{20}_O$" and an inner surface $\mathbf{20}_I$".

The body 20" is not composed of a rough, cardboard-based paper material. In some instances, the body 20" may include a non-cardboard-based paper material (e.g., a plastic material); hereinafter, the body 20" is referred to as a non-cardboard-based body. The non-cardboard-based body 20" may be formed, for example, in an injection molding procedure.

Comparatively, a Sheffield Smoothness (SS) of the non-cardboard-based body 20" is lower than a SS of a cardboard-based paper material. In some implementations, a cardboard-based paper material may be defined by a SS greater than 350 (e.g., a SS that is approximately equal to 370). In some implementations, the non-cardboard-based body 20" may be defined by a SS that is less than 350; in an exemplary embodiment, the non-cardboard-based body 20" may be defined by a SS approximately equal to 250.

As a result of the SS of the non-cardboard-based body 20" being less than the SS of a cardboard-based paper material, the inner surface $20_I$" of the non-cardboard-based body 20" is defined by a SS that is less than a SS of a cardboard-based paper material. Therefore, because the inner surface $20_I$" of non-cardboard-based body 20" defines the inner surface 16" of the cylindrical sleeve 12", the inner surface 16" of the cylindrical sleeve 12" includes a lower SS than, for example a rough, cardboard-based paper material.

Referring to FIGS. 2D and 3D, the exemplary cylindrical sleeve 12' is shown. The body 20''' defining the cylindrical sleeve 12''' includes at least a first material 20*a*''' and a second material 20'.

The first material 20*a*''' may include a cylindrical body having an inner surface $20a_I$''' and an outer surface $20a_O$". The outer surface $20a_O$" of the first material 20*a*''' may define at least a portion of the outer surface 18' of the cylindrical sleeve 12''' and at least a portion of the inner surface 16' of the cylindrical sleeve 12'''. The second material 20*b*''' may include a plurality of impregnations that are disposed throughout the cylindrical body of the first material 20*a*'''. Therefore, when the impregnations defining the second material 20*b*''' are entirely contained within the cylindrical body of the first material 20*a*''', in some instances, the second material 20*b*''' does not form an inner surface or outer surface that contributes to any of the inner surface 16' or the outer surface 18' of the cylindrical sleeve 12'; however, when the impregnations defining the second material 20*b*''' are not entirely contained within the cylindrical body of the first material 20*a*''', in some instances, the second material 20*b*''' may serially form a plurality of inner surface portions $20b_I$''' and a plurality of outer surface portions $20b_O$''' that defines at least a portion of the outer surface 18''' of the cylindrical sleeve 12' and at least a portion of the inner surface 16' of the cylindrical sleeve 12'''.

In some implementations, the first material 20*a*''' may include a rough, cardboard-based paper material that includes, but is not limited to a new/virgin paper material or a recycled paper material. In some instances, the second material 20*b*''' may include a hardwood material. Although the first material 20*a*''' of FIG. 2D, which may include a rough, cardboard-based paper material, is shown including one layer of material, the first material 20*a*''' is not limited to including one layer of material; accordingly, in some instances, the first material 20*a*''', which may include a rough, cardboard-based paper material, may include a plurality of layers of material. In some examples, a multi-layer first material 20*a*''' may be formed by winding a strip of rough, cardboard-based paper material (e.g., Brown Kraft paper, which may alternatively be referred to as recycled paper) on a mandrel in a spiral with edges of the rough, cardboard-based paper material arranged adjacent one another forming a spiral seam; subsequently, one or more second strips of rough, cardboard-based paper material may be wound over the first rough, cardboard-based paper material arranged upon the mandrel until the first material 20*a*''' is formed to include a desired thickness. In some instances, if, for example, the rough, cardboard-based paper material paper is 0.025" thick, and, a desired thickness of the first material 20*a*''' is 0.25", ten strips of rough, cardboard-based paper material may be utilized as described above for forming the first material 20*a*'''.

Comparatively, a Sheffield Smoothness (SS) of the second material 20*b*''' is lower than a SS of the first material 20*a*'''; in some implementations, the first material 20*a*''' may be defined by a SS greater than 350 (e.g., a SS that is approximately equal to 370). In some implementations, the second material 20*b*''' may be defined by a SS that is less than 350; in an exemplary embodiment, the second material 20*b*''' may be defined by a SS approximately equal to 250.

As a result of the SS of the second material 20*b*''' being less than the SS of the first material 20*a*''', the plurality of inner surface portions 20*b*''' of the second material 20*b*''' (that defines at least a portion of the inner surface 16''' of the cylindrical sleeve 12''') is defined by a SS that is less than a SS of the inner surface $20a_I$''' of the first material 20*a*''' (that also defines at least a portion of the inner surface 16''' of the cylindrical sleeve 12'''). Therefore, because the plurality of inner surface portions $20b_I$''' of the second material 20*b*''' defines at least a portion of the inner surface 16''' of the cylindrical sleeve 12''', the second material 20*b*''' reduces the SS of the inner surface 16''' of the cylindrical sleeve 12''' that is at least partially defined by the first material 20*a*''' including, for example a rough, cardboard-based paper material.

Figure 5A:
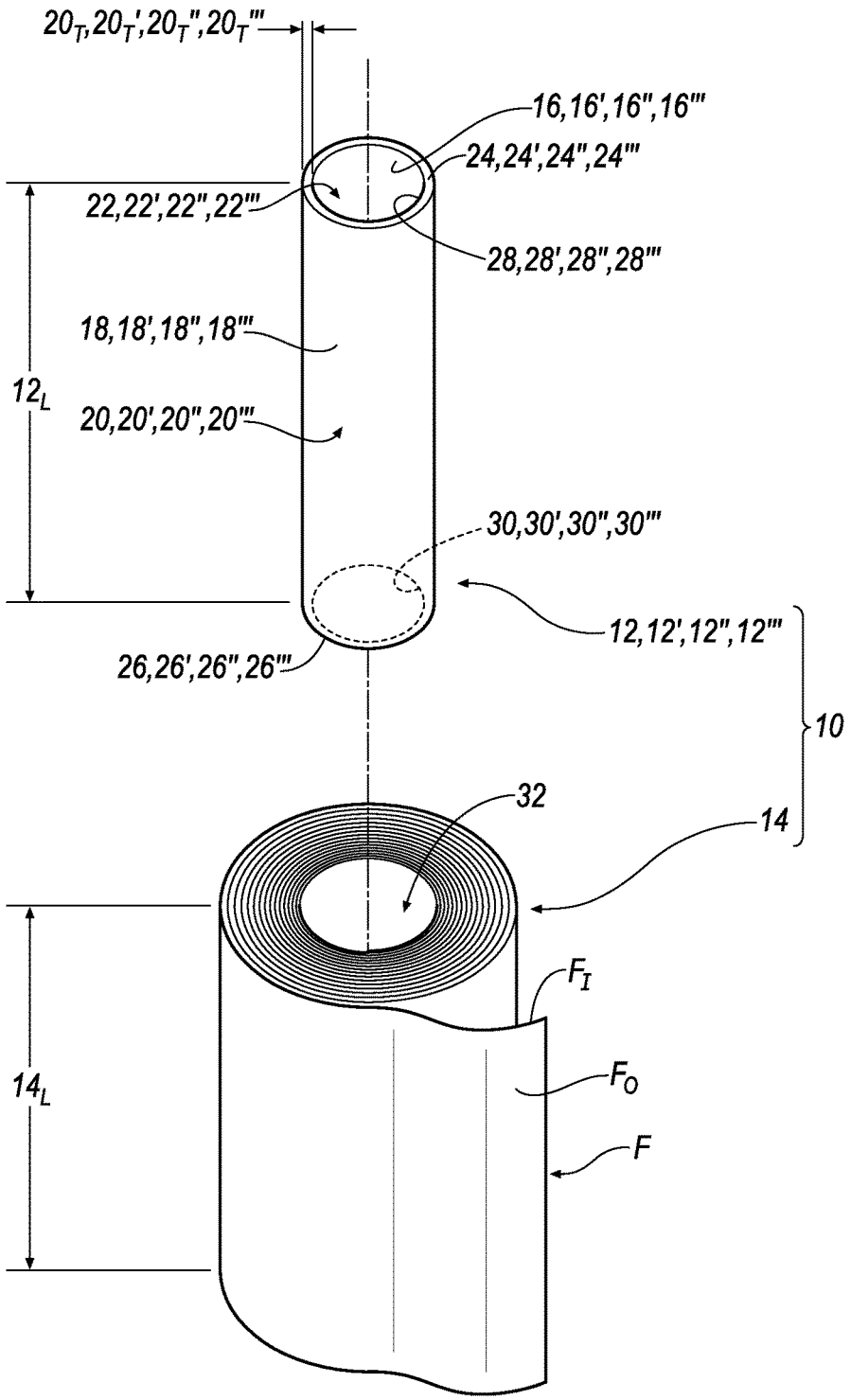
FIG. 5A is an exploded perspective view of an assembly including a cylindrical sleeve in accordance with an exemplary embodiment of the invention.
Figure 5B:
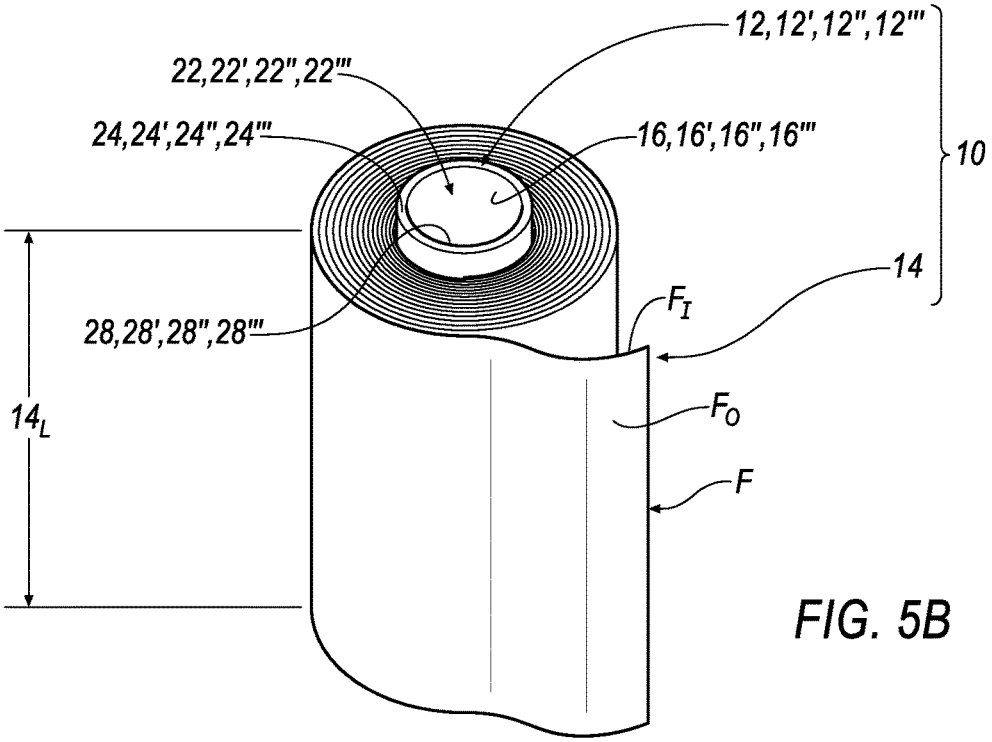
FIG. 5B is an assembled perspective view of the assembly of FIG. 5A.
Figure 5C:
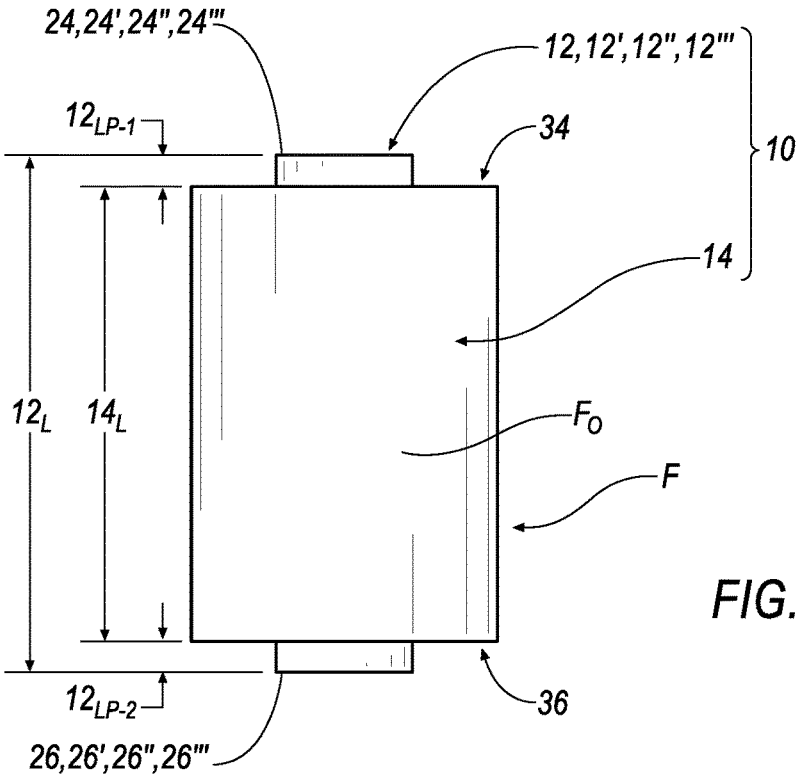
FIG. 5C is a side view of the assembly of FIG. 5B.

Referring to FIG. 4, because the inner surface 16, 16', 16", 16''' of the cylindrical sleeve 12, 12', 12", 12''' is defined by a lower SS in comparison to, for example, a rough, cardboard-based paper material, a user, U, may insert his her hands, H, directly into the passage 22, 22', 22", 22''' extending through the cylindrical sleeve 12, 12', 12", 12''' such that one or more of the user's, U, hands, H, may be in direct contact with the inner surface 16, 16', 16", 16''' of the cylindrical sleeve 12, 12', 12", 12''' when the wound roll 14 spins about an axis of rotation, A-A, as the length of wrapping film, F, is dispensed unwound from the wound roll 14 due to the lower SS of the inner surface 16, 16', 16", 16''' of the cylindrical sleeve 12, 12', 12", 12''' promoting increased comfort to the user's, U, hands, H, in comparison to, for example, a cylindrical sleeve that consists only of, for example, a rough, cardboard-based paper material. Further, because the inner surface 16, 16', 16", 16''' of the cylindrical sleeve 12, 12', 12", 12''' is defined by a lower SS in comparison to, for example, a rough, cardboard-based paper material, the assembly 10 obviates use of gloves for the user's, U, hands, H, due to the increased comfort imparted to the user's, U, hands, H. Even further, because the inner surface 16, 16', 16", 16''' of the cylindrical sleeve 12, 12', 12", 12''' is defined by a lower SS in comparison to, for example, a rough, cardboard-based paper material, the assembly 10 obviates use of an axial insert, which may include, for example, hand grips, that would otherwise be inserted into the passage 22, 22', 22", 22''' extending through the cylindrical sleeve 12, 12', 12", 12''' due to the increased comfort imparted to the user's, U, hands, H, as described above. Yet even further, although the cylindrical sleeve 12, 12', 12", 12''' and the wound roll 14 illustrated in FIG. 1B are shown having substantially aligned or substantially flush axial ends, some implementations of the assembly 10 may include portions $12_{LP\text{-}1}$, $12_{LP\text{-}2}$ (see, e.g., FIG. 5C) of the cylindrical sleeve 12, 12', 12", 12''' that extend beyond axial ends 34, 36 (see, e.g., FIG. 5C) of the wound roll 14. In some instances, as seen in, for example, FIGS. 5A-5C, the cylindrical sleeve 12, 12', 12", 12''' may include a length $12_L$ that is greater than a length $14_L$ of the wound roll 14; accordingly, when the cylindrical sleeve 12, 12', 12", 12''' is disposed within the passage 32 extending through the wound roll 14, a first portion $12_{LP\text{-}1}$ of the length $12_L$ of the cylindrical sleeve 12, 12', 12", 12''' may extend beyond an upper axial end 34 of the wound roll 14 and a second portion $12_{LP\text{-}2}$ of the length $12_L$ of the cylindrical sleeve 12, 12', 12", 12''' may extend beyond a lower axial end 36 of the wound roll 14. Such implementations may permit a user to grasp the outer surface 18, 18', 18", 18''' of the portions $12_{LP\text{-}1}$, $12_{LP\text{-}2}$ of the length $12_L$ of the cylindrical sleeve 12, 12', 12", 12'". In such implementations, a portion of the outer surface 18, 18', 18", 18'" of the cylindrical sleeve 12, 12', 12", 12'" may formed in a manner to define a lower SS in comparison to, for example, a rough, cardboard-based paper material in a substantially similar as described above with respect to the inner surface 16, 16', 16", 16'" of the cylindrical sleeve 12, 12', 12", 12'". In addition, some implementations of the assembly 10 may also include axial ends of the cylindrical sleeve 12, 12', 12", 12'" (that connect the inner surface 16, 16', 16", 16'" to the outer surface 18, 18', 18", 18'") that define a lower SS in comparison to, for example, a rough, cardboard-based paper material.

Referring to FIGS. 6A-6C, an assembly is shown generally at 10'. The assembly 10' includes a cylindrical sleeve 12' (see, e.g., FIGS. 7A and 8A), 12"'" (see, e.g., FIGS. 7B and 8B) or 12"'" (see, e.g., FIGS. 7C, 8C and 8C') and a wound roll 14. A length of material, F, that is wound upon itself may define the wound roll 14.

In some implementations, the length of material, F, may be a length of wrapping film. As seen in FIG. 9, the length of wrapping film, F, may be dispensed/unwound from the wound roll 14 by a user, U, such that the length of wrapping film, F, may be disposed about and wrap a plurality of goods, G, that are arranged upon a pallet, P. Although some implementations of the length of material, F, may include a length of wrapping film, the length of material, F, may not be limited to including a length of wrapping film, and may alternatively include, for example, a length of paper, a length of tin foil or the like.

Referring back to FIGS. 6A-6C, the cylindrical sleeve 12'''', 12''''', 12'''''' may include an inner surface 16'''', 16''''', 16'''''' and an outer surface 18'''', 18''''', 18''''''. The cylindrical sleeve 12'''', 12''''', 12'''''' is defined by a body 20'''', 20''''', 20'''''' of a first material 20 *a*'''' (see, e.g., FIG. 8A), 20 *a*''''' (see, e.g., FIG. 8B) and 20 *a*'''''' (see, e.g., FIG. 8C) and a second material 20 *b*'''' (see, e.g., FIG. 8A), 20 *b*''''' (see, e.g., FIG. 8B) and 20 *b*'''''' (see, e.g., FIG. 8C).

Referring to FIG. 6A, the body 20'''', 20''''', 20'''''' is defined by a thickness, 20 $_T$'''', 20 $_T$''''', 20 $_T$'''''', extending between the inner surface 16'''', 16''''', 16'''''' and the outer surface 18'''', 18''''', 18''''''. As seen in FIGS. 7A, 7B and 7C, each of the first material 20*a*'''', 20 *a*''''', 20 *a*'''''' and the second material 20 *b*'''', 20 *b*''''', 20*b*'''''' includes a substantially constant thickness for their respective lengths. Collectively, when the second material 20 *b*'''', 20 *b*''''', 20*b*'''''' is arranged relative the first material 20*a*'''', 20 *a*''''', 20 *a*'''''' to define the body 20'''', 20''''', 20'''''', the second material 20 *b*'''', 20 *b*''''', 20*b*'''''' is not arranged along all of the length of the first material 20*a*'''', 20 *a*''''', 20 *a*''''''; as a result, the body 20'''', 20''''', 20'''''' is defined by a non-constant thickness, 20 $_T$'''', 20 $_T$''''', 20 $_T$'''''', between the inner surface 16'''', 16''''', 16'''''' and the outer surface 18'''', 18''''', 18''''''' along the length, 12 $_L$, of the cylindrical sleeve 12'''', 12''''', 12''''''.

The inner surface 16'''', 16''''', 16'''''' defines a passage 22'''', 22''''', 22'''''' extending through the cylindrical sleeve 12'''', 12''''', 12'''''' between a distal end 24'''', 24''''', 24'''''' of the cylindrical sleeve 12'''', 12''''', 12'''''' and a proximal end 26'''', 26''''', 26'''''' of the cylindrical sleeve 12'''', 12''''', 12''''''. Access to the passage 22'''', 22''''', 22'''''' is permitted by a distal opening 28'''', 28''''', 28'''''' formed in the distal end 24'''', 24''''', 24'''''' of the cylindrical sleeve 12'''', 12''''', 12'''''' and a proximal opening 30'''', 30''''', 30'''''' formed in the proximal end 26'''', 26''''', 26'''''' of the cylindrical sleeve 12'''', 12''''', 12''''''.

The length of material, F, includes an inner surface, $F_I$, and an outer surface, $F_O$. Referring to FIG. 6A, a portion of the inner surface, $F_I$, of the length of material, F, forms a passage 32 extending through the wound roll 14. The outer surface 18'''', 18''''', 18''''''' of the cylindrical sleeve 12'''', 12''''', 12''''''' may be secured to the portion of the inner surface, $F_I$, of the length of material, F, that forms the passage 32 extending through the wound roll 14. In some implementations, an adhesive (not shown) may be disposed over one or both of the portion of the inner surface, $F_I$, of the length of material, F, that forms the passage 32 extending through the wound roll 14 and a portion of the outer surface 18'''', 18''''', 18''''''' of the cylindrical sleeve 12'''', 12''''', 12''''''' defined by the first material 20 *a*'''', 20 *a*''''', 20 *a*''''''' for securing the cylindrical sleeve 12'''', 12''''', 12''''''' to the wound roll 14.

The assembly 10' is further defined by portions 12 $_{LP\text{-}1}$, 12 $_{LP\text{-}2}$ (see, e.g., FIG. 6C) of the cylindrical sleeve 12'''', 12''''', 12''''''' that extend beyond axial ends 34, 36 (see, e.g., FIG. 6C) of the wound roll 14 due to the cylindrical sleeve 12'''', 12''''', 12''''''' including a length 12 $_L$ that is greater than a length 14 $_L$ of the wound roll 14; accordingly, when the cylindrical sleeve 12'''', 12''''', 12''''''' is disposed within the passage 32 extending through the wound roll 14, a first portion 12 $_{LP\text{-}1}$ of the length 12 $_L$ of the cylindrical sleeve 12'''', 12''''', 12''''''' may extend beyond an upper axial end 34 of the wound roll 14 and a second portion 12 $_{LP\text{-}2}$ of the length 12 $_L$ of the cylindrical sleeve 12'''', 12''''', 12''''''' may extend beyond a lower axial end 36 of the wound roll 14. Such an arrangement of the cylindrical sleeve 12'''', 12''''', 12''''''' arranged relative the wound roll 14 permits a user to grasp the outer surface 18'''', 18''''', 18''''''' of the cylindrical sleeve 12'''', 12''''', 12''''''' defined by the portions 12 $_{LP\text{-}1}$, 12 $_{LP\text{-}2}$ of the length 12 $_L$ of the cylindrical sleeve 12'''', 12''''', 12''''''. In such implementations, one or more of the inner surface 16'''', 16''''', 16''''''', the outer surface 18'''', 18''''', 18''''''', the distal end 24'''', 24''''', 24''''''' and the proximal end 26'''', 26''''', 26''''''' that defines the portions 12 $_{LP\text{-}1}$, 12 $_{LP\text{-}2}$ of the length 12 $_L$ of the cylindrical sleeve 12'''', 12''''', 12''''''' further includes (e.g., is covered by) a material defined by a lower Sheffield Smoothness (SS) in comparison to, for example, a material including, for example, a rough, cardboard-based paper material that may be utilized for forming the cylindrical sleeve 12'''', 12''''', 12''''''. The material defined by the lower SS may be, for example, the second material 20 *b*'''', 20 *b*''''', 20 *b*''''''.

Referring to FIGS. 7A and 8A, an exemplary cylindrical sleeve 12'''' is shown. Referring to FIG. 8A, the body 20'''' defining the cylindrical sleeve 12'''' includes at least the first material 20*a*'''' and the second material 20*b*''''.

The first material 20*a*'''' may include a cylindrical body having an inner surface 20$a_I$'''' (see, e.g., FIG. 8A) and an outer surface 20$a_O$'''' (see, e.g., FIG. 8A). All of the outer surface 20$a_O$'''' of the first material 20*a*'''' may define the outer surface 18'''' of the cylindrical sleeve 12''''.

The second material 20*b*'''' may include a first cylindrical body portion 20*b*1'''' and a second cylindrical body portion 20*b*2'''' each having an inner surface 20$b_I$'''' (see, e.g., FIG. 8A) and an outer surface 20$b_O$'''' (see, e.g., FIG. 8A). The inner surface 20*b* $_I$'''' of the second material 20*b*'''' may define, respectively, upper and lower portions of the inner surface 16'''' of the cylindrical sleeve 12'''' due to: (1) a first portion of the inner surface 20*a* $_I$'''' of the first material 20*a*'''' (that is proximate the distal end 24'''') being disposed adjacent the outer surface 20$b_O$'''' of the first cylindrical body portion 20*b* $_I$'''' of the second material 20*b*'''', and, (2) a second portion of the inner surface 20*a* $_I$'''' of the first material 20*a*'''' (that is proximate the proximal end 26'''')

being disposed adjacent the outer surface 20$b_O$'''' of the second cylindrical body portion 20$b$2'''' of the second material 20$b$''''.

In some implementations, the first cylindrical body portion 20$b$1'''' and the second cylindrical body portion 20$b$2'''' defining the second material 20$b$'''' are liners that are disposed over the inner surface 20$a_I$'''' of the first material 20$a$''''. The first cylindrical body portion 20$b$1'''' extends along the inner surface 20$a_I$'''' of the first material 20$a$'''' from the distal end 24'''' of the cylindrical sleeve 12'''' and may be defined by a length dimension that is approximately equal to a length dimension of the portion $\mathbf{12}_{LP\text{-}1}$ of the length $\mathbf{12}_L$ of the cylindrical sleeve 12'''', and, the second cylindrical body portion 20$b$2'''' extends along the inner surface 20$a$'''' of the first material 20$a$'''' from the proximal end 26'''' of the cylindrical sleeve 12'''' and may be defined by a length dimension that is approximately equal to a length dimension of the portion $\mathbf{12}_{LP\text{-}2}$ of the length $\mathbf{12}_L$ of the cylindrical sleeve 12''''. As a result of the arrangement of the first cylindrical body portion 20$b$1'''' and the second cylindrical body portion 20$b$2'''' defining the second material 20$b$'''' relative the first material 20$a$'''' as described above, a middle portion 20$a_{MI}$'''' of the inner surface 20$a_I$'''' of the first material 20$a$'''' is not covered by the second material 20$b$''''; the middle portion 20$a_{MI}$'''' of the inner surface 20$a_I$'''' of the first material 20$a$'''' may define an intermediate portion of the inner surface 16'''' of the cylindrical sleeve 12''''. In some examples, the outer surface 20$b_O$'''' of the second material 20$b$'''' is secured to the inner surface 20$a_I$'''' of the first material 20$a$'''' by an adhesive (not shown).

In some implementations, the first material 20$a$'''' may include a rough, cardboard-based paper material that includes, but is not limited to a new/virgin paper material or a recycled paper material. In some examples, the second material 20$b$'''' may include a paper material (e.g., a paper lining including a plush characteristic, such as velvet). In some instances, the second material 20$b$'''' may include a non-paper material (e.g., a plastic lining). Although the first material 20$a$'''' of FIG. 7A, which may include a rough, cardboard-based paper material, is shown including one layer of material, the first material 20$a$'''' is not limited to including one layer of material; accordingly, in some instances, the first material 20$a$'''', which may include a rough, cardboard-based paper material, may include a plurality of layers of material. In some examples, a multi-layer first material 20$a$'''' may be formed by winding a strip of rough, cardboard-based paper material (e.g., Brown Kraft paper, which may alternatively be referred to as recycled paper) on a mandrel in a spiral with edges of the rough, cardboard-based paper material arranged adjacent one another forming a spiral seam; subsequently, one or more second strips of rough, cardboard-based paper material may be wound over the first rough, cardboard-based paper material arranged upon the mandrel until the first material 20$a$'''' is formed to include a desired thickness. In some instances, if, for example, the rough, cardboard-based paper material paper is 0.025" thick, and, a desired thickness of the first material 20$a$'''' is 0.25", ten strips of rough, cardboard-based paper material may be utilized as described above for forming the first material 20$a$''''.

Comparatively, the Sheffield Smoothness (SS) of the second material 20$b$'''' is lower than a SS of the first material 20$a$''''; in some implementations, the first material 20$a$'''' may be defined by a SS greater than 350 (e.g., a SS that is approximately equal to 370). In some implementations, the second material 20$b$'''' may be defined by a SS that is less than 350; in an exemplary embodiment, the second material 20$b$'''' may be defined by a SS approximately equal to 250.

As a result of the SS of the second material 20$b$'''' being less than the SS of the first material 20$a$'''', the inner surface 20$b_I$'''' of the second material 20$b$'''' is defined by a SS that is less than a SS of the inner surface 20$a_I$'''' of the first material 20$a$''''. Therefore, because the inner surface 20$b_I$'''' of the second material 20$b$'''' (defined by the first cylindrical body portion 20$b$1'''' and the second cylindrical body portion 20$b$2'''') defines two portions (i.e., an upper portion and a lower portion) of the inner surface 16'''' of the cylindrical sleeve 12'''', two portions of the inner surface 16'''' of the cylindrical sleeve 12'''' include a lower SS than, for example a rough, cardboard-based paper material defined by the exposed middle portion 20$a_{MI}$'''' of the inner surface 20$a_I$'''' of the first material 20$a$'''' that is not covered by the second material 20$b$'''' and therefore defines an intermediate portion of the inner surface 16'''' of the cylindrical sleeve 12''''.

Referring to FIGS. 7B and 8B, an exemplary cylindrical sleeve 12''''' is shown. Referring to FIG. 8B, the body 20''''' defining the cylindrical sleeve 12''''' includes at least the first material 20$a$''''' and the second material 20$b$'''''.

The first material 20$a$''''' may include a cylindrical body having an inner surface 20$a_I$''''' (see, e.g., FIG. 8B) and an outer surface 20$a_O$''''' (see, e.g., FIG. 8B). The second material 20$b$''''' may include a first cylindrical body portion 20$b$1''''', a second cylindrical body portion 20$b$2''''', a third cylindrical body portion 20$b$3''''' and a fourth cylindrical body portion 20$b$4''''' each having an inner surface 20$b_I$''''' (see, e.g., FIG. 8B) and an outer surface 20$b_O$''''' (see, e.g., FIG. 8B). The inner surface 20$b_I$''''' of the second material 20$b$''''' defined by first cylindrical body portion 20$b$1''''' and the second cylindrical body portion 20$b$2''''' may define, respectively, upper and lower portions of the inner surface 16''''' of the cylindrical sleeve 12''''' due to: (1) a first portion of the inner surface 20$a_I$''''' of the first material 20$a$''''' (that is proximate the distal end 24''''') being disposed adjacent the outer surface 20$b_O$''''' of the first cylindrical body portion 20$b$1''''' of the second material 20$b$''''', and, (2) a second portion of the inner surface 20$a_I$''''' of the first material 20$a$''''' (that is proximate the proximal end 26''''') being disposed adjacent the outer surface 20$b_O$''''' of the second cylindrical body portion 20$b$2''''' of the second material 20$b$'''''.

In some implementations, the first cylindrical body portion 20$b$1''''' and the second cylindrical body portion 20$b$2''''' defining the second material 20$b$''''' are liners that are disposed over the inner surface 20$a_I$''''' of the first material 20$a$''''''. The first cylindrical body portion 20$b$1''''' extends along the inner surface 20$a_I$''''' of the first material 20$a$''''' from the distal end 24''''' of the cylindrical sleeve 12''''' and may be defined by a length dimension that is approximately equal to a length dimension of the portion $\mathbf{12}_{LP\text{-}1}$ of the length $\mathbf{12}_L$ of the cylindrical sleeve 12''''', and the second cylindrical body portion 20$b$2''''' extends along the inner surface 20$a_I$''''' of the first material 20$a$''''' from the proximal end 26''''' of the cylindrical sleeve 12''''' and may be defined by a length dimension that is approximately equal to a length dimension of the portion $\mathbf{12}_{LP\text{-}2}$ of the length $\mathbf{12}_L$ of the cylindrical sleeve 12''''''. As a result of the arrangement of the first cylindrical body portion 20$b$1''''' and the second cylindrical body portion 20$b$2''''' defining the second material 20$b$''''' relative the first material 20$a$''''' as described above, a middle portion 20$a_{MI}$''''' of the inner surface 20$a_I$''''' of the first material 20$a$''''' is not covered by the second material 20$b$''''''; the middle portion 20$a_{MI}$''''' of the inner surface 20$a_I$''''' of the first material 20$a$''''' may define an intermediate portion of the inner surface 16"""" of the cylindrical sleeve 12"""". In some examples, the outer surface 20$b_O$"""" of the second material 20*b*"""" (defined by the first cylindrical body portion 20*b*1"""" and the second cylindrical body portion 20*b*2"""") is secured to the inner surface 20$a_I$"""" of the first material 20*a*"""" by an adhesive (not shown).

The outer surface 20$b_O$"""" of the second material 20*b*"""" defined by third cylindrical body portion 20*b*3"""" and the fourth cylindrical body portion 20*b*4"""" may define, respectively, upper and lower portions of the outer surface 18"""" of the cylindrical sleeve 12"""" due to: (1) a first portion of the outer surface 20$a_O$"""" of the first material 20*a*"""" being disposed adjacent the inner surface 20$b_I$"""" of the third cylindrical body portion 20*b*3"""" of the second material 20*b*"""", and, (2) a second portion of the outer surface 20$a_O$"""" of the first material 20*a*"""" being disposed adjacent the inner surface 20$b_I$"""" of the fourth cylindrical body portion 20*b*4"""" of the second material 20*b*"""". In some implementations, the third cylindrical body portion 20*b*3"""" and the fourth cylindrical body portion 20*b*4"""" defining the second material 20*b*"""" are liners that are disposed over the outer surface 20$a_O$"""" of the first material 20*a*"""". The third cylindrical body portion 20*b*3"""" extends along the outer surface 20$a_O$"""" of the first material 20*a*"""" from the distal end 24"""" of the cylindrical sleeve 12"""" and may be defined by a length dimension that is approximately equal to a length dimension of the portion $\mathbf{12}_{LP\text{-}1}$ of the length $\mathbf{12}_L$ of the cylindrical sleeve 12"""", and the fourth cylindrical body portion 20*b*4"""" extends along the outer surface 20$a_O$"""" of the first material 20*a*"""" from the proximal end 26"""" of the cylindrical sleeve 12"""" and may be defined by a length dimension that is approximately equal to a length dimension of the portion $\mathbf{12}_{LP\text{-}2}$ of the length $\mathbf{12}_L$ of the cylindrical sleeve 12"""". As a result of the arrangement of the third cylindrical body portion 20*b*3"""" and the fourth cylindrical body portion 20*b*4"""" defining the second material 20*b*"""" relative the first material 20*a*"""" as described above, a middle portion 20$a_{MO}$"""" of the outer surface 20$a_O$"""" of the first material 20*a*"""" is not covered by the second material 20*b*""""; the middle portion 20$a_{MO}$"""" of the outer surface 20$a_O$"""" of the first material 20*a*"""" may define an intermediate portion of the outer surface 18"""" of the cylindrical sleeve 12"""". In some examples, the inner surface 20$b_I$"""" of the second material 20*b*"""" (defined by the third cylindrical body portion 20*b*3"""" and the fourth cylindrical body portion 20*b*4"""") is secured to the outer surface 20$a_O$"""" of the first material 20*a*"""" by an adhesive (not shown).

In some implementations, the first material 20*a*"""" may include a rough, cardboard-based paper material that includes, but is not limited to a new/virgin paper material or a recycled paper material. In some examples, the second material 20*b*"""" may include a paper material (e.g., a paper lining including a plush characteristic, such as velvet or bleached board). In some instances, the second material 20*b*"""" may include a non-paper material (e.g., a plastic lining). Although the first material 20*a*"""" of FIG. 7B, which may include a rough, cardboard-based paper material, is shown including one layer of material, the first material 20*a*"""" is not limited to including one layer of material; accordingly, in some instances, the first material 20*a*"""", which may include a rough, cardboard-based paper material, may include a plurality of layers of material. In some examples, a multi-layer first material 20*a*"""" may be formed by winding a strip of rough, cardboard-based paper material (e.g., Brown Kraft paper, which may alternatively be referred to as recycled paper) on a mandrel in a spiral with edges of the rough, cardboard-based paper material arranged adjacent one another forming a spiral seam; subsequently, one or more second strips of rough, cardboard-based paper material may be wound over the first rough, cardboard-based paper material arranged upon the mandrel until the first material 20*a*"""" is formed to include a desired thickness. In some instances, if, for example, the rough, cardboard-based paper material paper is 0.025" thick, and, a desired thickness of the first material 20*a*"""" is 0.25", ten strips of rough, cardboard-based paper material may be utilized as described above for forming the first material 20*a*""""".

Comparatively, the Sheffield Smoothness (SS) of the second material 20*b*"""" is lower than a SS of the first material 20*a*""""; in some implementations, the first material 20*a*"""" may be defined by a SS greater than 350 (e.g., a SS that is approximately equal to 370). In some implementations, the second material 20*b*"""" may be defined by a SS that is less than 350; in an exemplary embodiment, the second material 20*b*"""" may be defined by a SS approximately equal to 250.

As a result of the SS of the second material 20*b*"""" being less than the SS of the first material 20*a*"""", the inner surface 20$b_I$"""" and the outer surface 20$b_O$"""" of the second material 20*b*"""" are each defined by a SS that is less than a SS of the inner surface 20$a_I$"""" and the outer surface 20$a_O$"""" of the first material 20*a*"""". Therefore, because the inner surface 20$b_I$"""" of the second material 20*b*"""" (defined by the first cylindrical body portion 20*b*1"""" and the second cylindrical body portion 20*b*2"""") defines two portions (i.e., an upper portion and a lower portion) of the inner surface 16"""" of the cylindrical sleeve 12"""", two portions of the inner surface 16"""" of the cylindrical sleeve 12"""" include a lower SS than, for example a rough, cardboard-based paper material defined by the exposed middle portion 20$a_{MI}$"""" of the inner surface 20$a_I$"""" of the first material 20*a*"""" that is not covered by the second material 20*b*"""" (defined by the first cylindrical body portion 20*b*1"""" and the second cylindrical body portion 20*b*2"""") and therefore, defines an intermediate portion of the inner surface 16"""" of the cylindrical sleeve 12""""; similarly, because the outer surface 20$b_O$"""" of the second material 20*b*"""" (defined by the third cylindrical body portion 20*b*3"""" and the fourth cylindrical body portion 20*b*4"""") defines two portions of the outer surface 18"""" of the cylindrical sleeve 12"""", two portions (i.e., an upper portion and a lower portion) of the outer surface 18"""" of the cylindrical sleeve 12"""" include a lower SS than, for example a rough, cardboard-based paper material defined by the exposed middle portion 20$a_{MO}$"""" of the outer surface 20$a_O$"""" of the first material 20*a*"""" that is not covered by the second material 20*b*"""" (defined by the third cylindrical body portion 20*b*3"""" and the fourth cylindrical body portion 20*b*4"""") and therefore, defines an intermediate portion of the outer surface 18"""" of the cylindrical sleeve 12"""".

Referring to FIGS. 7C, 8C, 8C', 8C", an exemplary cylindrical sleeve 12"""" is shown. Referring to FIGS. 8C, 8C', 8C", the body 20"""" defining the cylindrical sleeve 12"""" includes at least the first material 20*a*"""" and the second material 20*b*""""".

The first material 20*a*"""" may include a cylindrical body having an inner surface 20$a_I$"""" (see, e.g., FIG. 8C) and an outer surface 20$a_O$"""" (see, e.g., FIG. 8C). The second material 20*b*"""" may include a first cylindrical body portion 20*b*1"""", a second cylindrical body portion 20*b*2"""", a third cylindrical body portion 20*b*3"""", a fourth cylindrical body portion 20*b*4"""", a first annular ring portion 20*b*5"""" and a second annular ring portion 20*b*"""" each having an inner surface $20b_I$''''' (see, e.g., FIG. 8C, 8C', 8C'') and an outer surface $20b_O$''''' (see, e.g., FIG. 8C, 8C', 8C'').

Referring to FIG. 8C', each of the first cylindrical body portion 20b1''''' and the third cylindrical body portion 20b3''''' have a distal end surface $20b_D$'''''. Referring to FIG. 8C'', each of the second cylindrical body portion 20b2''''' and the fourth cylindrical body portion 20b4''''' have a proximal end surface $20b_P$'''''.

The inner surface $20b_I$''''' of the second material 20b''''' defined by first cylindrical body portion 20b1''''' and the second cylindrical body portion 20b2''''' may define, respectively, upper and lower portions of the inner surface 16''''' of the cylindrical sleeve 12''''' due to: (1) a first portion of the inner surface 20a''''' of the first material 20a''''' being disposed adjacent the outer surface $20b_O$''''' of the first cylindrical body portion 20b1''''' of the second material 20b''''', and, (2) a second portion of the inner surface $20a_I$''''' of the first material 20a''''' being disposed adjacent the outer surface $20b_O$''''' of the second cylindrical body portion 20b2''''' of the second material 20b'''''.

In some implementations, the first cylindrical body portion 20b1''''' and the second cylindrical body portion 20b2''''' defining the second material 20b''''' are liners that are disposed over the inner surface $20a_I$''''' of the first material 20a''''''. The first cylindrical body portion 20b1''''' extends along the inner surface $20a_I$''''' of the first material 20a''''' from the distal end 24''''' of the cylindrical sleeve 12''''' and may be defined by a length dimension that is slightly greater than a length dimension of the portion $12_{LP-1}$ of the length $12_L$ of the cylindrical sleeve 12''''', and the second cylindrical body portion 20b2''''' extends along the inner surface $20a_I$''''' of the first material 20a''''' from the proximal end 26''''' of the cylindrical sleeve 12''''' and may be defined by a length dimension that is slightly greater than a length dimension of the portion $12_{LP-2}$ of the length $12_L$ of the cylindrical sleeve 12'''''. As a result of the arrangement of the first cylindrical body portion 20b1''''' and the second cylindrical body portion 20b2''''' defining the second material 20b''''' relative the first material 20a''''' as described above, a middle portion $20a_{MI}$''''' of the inner surface $20a_I$''''' of the first material 20a''''' is not covered by the second material 20b''''''; the middle portion $20a_{MI}$''''' of the inner surface $20a_I$''''' of the first material 20a''''' may define an intermediate portion of the inner surface 16''''' of the cylindrical sleeve 12'''''. In some examples, the outer surface $20b_O$''''' of the second material 20b''''' (defined by the first cylindrical body portion 20b1''''' and the second cylindrical body portion 20b2''''') is secured to the inner surface $20a_I$''''' of the first material 20a''''' by an adhesive (not shown).

The outer surface $20b_O$''''' of the second material 20b''''' defined by third cylindrical body portion 20b3''''' and the fourth cylindrical body portion 20b''''' may define, respectively, upper and lower portions of the outer surface 18''''' of the cylindrical sleeve 12''''' due to: (1) a first portion of the outer surface $20a_O$''''' of the first material 20a''''' being disposed adjacent the inner surface $20b_I$''''' of the third cylindrical body portion 20b3''''' of the second material 20b''''', and, (2) a second portion of the outer surface $20a_O$''''' of the first material 20a''''' being disposed adjacent the inner surface $20b_I$''''' of the fourth cylindrical body portion 20b4''''' of the second material 20b''''''. In some implementations, the third cylindrical body portion 20b3''''' and the fourth cylindrical body portion 20b4''''' defining the second material 20b''''' are liners that are disposed over the outer surface $20a_O$''''' of the first material 20a''''''. The third cylindrical body portion 20b3''''' extends along the outer surface $20a_O$''''' of the first material 20a''''' from the distal end 24''''' of the cylindrical sleeve 12''''' and may be defined by a length dimension that is approximately equal to a length dimension of the portion $12_{LP-1}$ of the length $12_L$ of the cylindrical sleeve 12''''', and the fourth cylindrical body portion 20b4''''' extends along the outer surface $20a_O$''''' of the first material 20a''''' from the proximal end 26''''' of the cylindrical sleeve 12''''' and may be defined by a length dimension that is approximately equal to a length dimension of the portion $12_{LP-2}$ of the length $12_L$ of the cylindrical sleeve 12'. As a result of the arrangement of the third cylindrical body portion 20b3''''' and the fourth cylindrical body portion 20b4''''' defining the second material 20b''''' relative the first material 20a''''' as described above, a middle portion $20a_{MO}$''''' of the outer surface $20a_O$''''' of the first material 20a''''' is not covered by the second material 20 *b*''''''; the middle portion $20a_{MO}$''''' of the outer surface $20a_O$''''' of the first material 20a''''' may define an intermediate portion of the outer surface 18''''' of the cylindrical sleeve 12'''''. In some examples, the inner surface $20b_I$''''' of the second material 20b''''' (defined by the third cylindrical body portion 20b3''''' and the fourth cylindrical body portion 20b4''''') is secured to the outer surface $20a_O$''''' of the first material 20a''''' by an adhesive (not shown).

Referring to FIG. 8C', the first annular ring portion 20b5''''' is defined by a width dimension $20b5_W$''''' that is approximately equal to a combined thickness of: (1) the first material 20a''''''', (2) the first cylindrical body portion 20b1''''' of the second material 20b''''' and (3) the third cylindrical body portion 20b3''''' of the second material 20b''''''. An inner surface $20b_I$''''' of the first annular ring portion 20b5''''' may be disposed adjacent: (1) the distal end $20a_D$''''' of the cylindrical body formed by the first material 20a''''' and (2) the distal end surface $20b_D$''''' of both of the first cylindrical body portion 20b1''''' and the third cylindrical body portion 20b3'''''.

In some examples, the inner surface $20b_I$''''' of the second material 20b''''' defined by the first annular ring portion 20b5''''' is secured by an adhesive (not shown) to: (1) the distal end $20a_D$''''' of the cylindrical body formed by the first material 20a''''' and (2) the distal end surface $20b_D$''''' of both of the first cylindrical body portion 20b1''''' and the third cylindrical body portion 20b3'''''. Although the first annular ring portion 20b5''''' (which may be a portion of the second material 20b''''') is described above as being secured by an adhesive to the distal end surface $20b_D$''''' of both of the first cylindrical body portion 20b1''''' and the third cylindrical body portion 20b3''''', the first annular ring portion 20b5''''' may be integrally formed with each of first cylindrical body portion 20b1''''' and the third cylindrical body portion 20b3''''' at the distal end surface $20b_D$''''' of both of the first cylindrical body portion 20b1''''' and the third cylindrical body portion 20b3'''''.

Referring to FIG. 8C'', the second annular ring portion 20b6''''' is defined by a width dimension $20b6_W$''''' that is approximately equal to a combined thickness of: (1) the first material 20a''''''', (2) the second cylindrical body portion 20b2''''' of the second material 20b''''' and (3) the fourth cylindrical body portion 20b4''''' of the second material 20b''''''. An inner surface $20b_I$''''' of the second annular ring portion 20b6''''' may be disposed adjacent: (1) the proximal end $20a_P$''''' of the cylindrical body formed by the first material 20a''''' and (2) the proximal end surface $20b_P$''''' of both of the second cylindrical body portion 20b2''''' and the fourth cylindrical body portion 20b4'''''.

In some examples, the inner surface 20$b_I$''''' of the second material 20$b$''''' defined by the second annular ring portion 20$b$6''''' is secured by an adhesive (not shown) to: (1) the proximal end 20$a_P$''''' of the cylindrical body formed by the first material 20$a$''''' and (2) the proximal end surface 20$b_P$''''' of both of the second cylindrical body portion 20$b$2''''' and the fourth cylindrical body portion 20$b$4'''''. Although the second annular ring portion 20$b$6''''' (which may be a portion of the second material 20$b$''''') is described above as being secured by an adhesive to the proximal end surface 20$b_P$''''' of both of the second cylindrical body portion 20$b$2''''' and the fourth cylindrical body portion 20$b$4''''', the second annular ring portion 20$b$6''''' may be integrally formed with each of second cylindrical body portion 20$b$2''''' and the fourth cylindrical body portion 20$b$4''''' the proximal end surface 20$b_P$''''' of both of the second cylindrical body portion 20$b$2''''' and the fourth cylindrical body portion 20$b$4'''''.

In some implementations, the first material 20$a$''''' may include a rough, cardboard-based paper material that includes, but is not limited to a new/virgin paper material or a recycled paper material. In some examples, the second material 20$b$''''' may include a paper material (e.g., a paper lining including a plush characteristic, such as velvet). In some instances, the second material 20$b$''''' may include a non-paper material (e.g., a plastic lining). Although the first material 20$a$''''' of FIG. 7C, which may include a rough, cardboard-based paper material, is shown including one layer of material, the first material 20$a$''''' is not limited to including one layer of material; accordingly, in some instances, the first material 20$a$''''', which may include a rough, cardboard-based paper material, may include a plurality of layers of material. In some examples, a multi-layer first material 20$a$''''' may be formed by winding a strip of rough, cardboard-based paper material (e.g., Brown Kraft paper, which may alternatively be referred to as recycled paper) on a mandrel in a spiral with edges of the rough, cardboard-based paper material arranged adjacent one another forming a spiral seam; subsequently, one or more second strips of rough, cardboard-based paper material may be wound over the first rough, cardboard-based paper material arranged upon the mandrel until the first material 20$a$''''' is formed to include a desired thickness. In some instances, if, for example, the rough, cardboard-based paper material paper is 0.025" thick, and, a desired thickness of the first material 20$a$''''' is 0.25", ten strips of rough, cardboard-based paper material may be utilized as described above for forming the first material 20$a$'''''.

Comparatively, the Sheffield Smoothness (SS) of the second material 20$b$''''' is lower than a SS of the first material 20$a$'''''; in some implementations, the first material 20$a$''''' may be defined by a SS greater than 350 (e.g., a SS that is approximately equal to 370). In some implementations, the second material 20$b$''''' may be defined by a SS that is less than 350; in an exemplary embodiment, the second material 20$b$''''' may be defined by a SS approximately equal to 250.

As a result of the SS of the second material 20$b$''''' being less than the SS of the first material 20$a$''''', the inner surface 20$b_I$''''' and the outer surface 20$b_O$''''' of the second material 20$b$''''' are each defined by a SS that is less than a SS of the inner surface 20$a_I$''''' and the outer surface 20$a_O$''''' of the first material 20$a$''''. Therefore, because the inner surface 20$b_I$''''' of the second material 20$b$''''' (defined by the first cylindrical body portion 20 $bl$''''' and the second cylindrical body portion 20$b$2''''') defines two portions (i.e., an upper portion and a lower portion) of the inner surface 16''''' of the cylindrical sleeve 12'''''', two portions of the inner surface 16''''' of the cylindrical sleeve 12'''''' include a lower SS than, for example a rough, cardboard-based paper material defined by the exposed middle portion 20$a_{MI}$''''' of the inner surface 20$a_I$''''' of the first material 20$a$''''' that is not covered by the second material 20$b$''''' (defined by the first cylindrical body portion 20$b$1''''' and the second cylindrical body portion 20$b$2''''') and therefore, defines an intermediate portion of the inner surface 16''''' of the cylindrical sleeve 12''''''; similarly, because the outer surface 20$b_O$''''' of the second material 20$b$''''' (defined by the third cylindrical body portion 20$b$3''''', the fourth cylindrical body portion 20$b$4''''', the first annular ring portion 20$b$5''''' and the second annular ring portion 20$b$6''''') defines two portions (i.e., an upper portion and a lower portion) of the outer surface 18''''' as well as the distal end 24''''' and the proximal end 26''''' of the cylindrical sleeve 12''''', two portions of the outer surface 18''''' of the cylindrical sleeve 12''''' as well as the distal end 24''''' and the proximal end 26''''' of the cylindrical sleeve 12''''' include a lower SS than, for example a rough, cardboard-based paper material defined by the distal and proximal ends of the first material 20$a$''''' as well as the exposed middle portion 20$a_{MO}$''''' of the outer surface 20$a_O$''''' of the first material 20$a$''''' that is not covered by the second material 20$b$''''' (defined by the third cylindrical body portion 20$b$3''''' and the fourth cylindrical body portion 20$b$4''''') and therefore, defines an intermediate portion of the outer surface 18''''' of the cylindrical sleeve 12''''''.

With reference to FIG. 9, and, as described above at FIGS. 7A-8C", the second material 20$b$''''', 20$b$''''', 20$b$''''', which includes a lower SS than the first material 20$a$''''', 20$a$''''', 20$a$''''', may define one or more of: the inner surface 16''''', 16''''', 16''''', the outer surface 18''''', 18''''', the distal end 24''''' and the proximal end 26''''' of the portions 12$_{LP\text{-}1}$, 12$_{LP\text{-}2}$ of the length 12$_L$ of the cylindrical sleeve 12''''', 12''''', 12''''''. The "lower" SS of the second material 20$b$''''', 20$b$''''', 20$b$''''' may be referenced in comparison to, for example, a "higher" SS of the first material 20$a$''''', 20$a$''''', 20$a$''''''. Accordingly, as seen in FIGS. 7A, 7B and 7C, when: (1) a user, U, arranges his/her hands, H, about the portions 12$_{LP\text{-}1}$, 12$_{LP\text{-}2}$ of the length 12$_L$ of the cylindrical sleeve 12''''', 12''''', 12''''' and (2) the wound roll 14 spins about an axis of rotation, A-A, as the length of wrapping film, F, is dispensed/unwound from the wound roll 14, the lower SS of the second material 20$b$''''', 20$b$''''', 20$b$''''' promotes increased comfort to the user's, U, hands, H, in comparison to, for example, a cylindrical sleeve that consists only of, for example, a rough, cardboard-based paper material. The arrangement of the second material 20$b$''''', 20$b$''''', 20$b$''''' relative the first material 20$a$''''', 20$a$''''', 20$a$''''' as seen at, for example, FIGS. 7A, 7B and 7C provides a variety of configurations that promotes varying levels of comfort to the user's, U, hands, H, as well as varying levels of an amount of second material 20$b$''''', 20$b$''''', 20$b$''''' utilized in the manufacturing of the cylindrical sleeve 12''''', 12''''', 12''''''.

In an example as seen in FIG. 7A, the second material 20$b$''''' is only applied to portions of the inner surface 20$a$''''' of the first material 20$a$''''' that extend along portions of the inner surface 20$a_I$''''' of the first material 20$a$''''' for only about a length dimension of the portions 12$_{LP\text{-}1}$, 12$_{LP\text{-}2}$ of the length 12$_L$ of the cylindrical sleeve 12''''''. As a result, the design of the cylindrical sleeve 12''''' calls for less utilization of the second material 20$b$''''', which decreases manufacturing costs of the cylindrical sleeve 12''''', but, however, provides two comfort points of contact when the user's, U, hands, H, comes into contact with the second material 20$b''''''$.

In another example as seen in FIG. 7B, the second material 20$b''''''$ is applied to portions of both of the inner surface 20$a_I''''''$ and the outer surface 20$a_O''''''$ of the first material 20$a''''''$ such that the second material 20$b''''''$ extends, respectively, along portions of the inner surface 20$a_I''''''$ and the outer surface 20$a_O''''''$ of the first material 20$a''''''$ for only about a length dimension of the portions 12$_{LP\text{-}1}$, 12$_{LP\text{-}2}$ of the length 12$_L$ of the cylindrical sleeve 12$''''''$. As a result, the design of the cylindrical sleeve 12$''''''$ calling for more utilization of the second material 20$b''''''$ (in comparison to the embodiment described at FIG. 7A), which slightly increases manufacturing costs of the cylindrical sleeve 12$''''''$, but, however, provides four comfort points of contact when the user's, U, hands, H, comes into contact with the second material 20$b''''''$.

In another example as seen in FIG. 7C, the second material 20$b''''''$ is applied to portions of both of the inner surface 20$a_I''''''$ and the outer surface 20$a_O''''''$ of the first material 20$a''''''$ such that the second material 20$b''''''$ extends, respectively, along portions of the inner surface 20$a_I''''''$ and the outer surface 20$a_O''''''$ of the first material 20$a''''''$ for more than a length dimension of the portions 12$_{LP\text{-}1}$, 12$_{LP\text{-}2}$ of the length 12$_L$ of the cylindrical sleeve 12$''''''$; by permitting the second material 20$b''''''$ to extend beyond the length dimension of the portions 12$_{LP\text{-}1}$, 12$_{LP\text{-}2}$ of the length 12$_L$ of the cylindrical sleeve 12$''''''$, the user, U, is permitted to have increased comfort as the user, U, extends his/her hands deeper into the passage 22$''''''$ when compared to, for example, the embodiments described at FIGS. 7A and 7B. Further, the second material 20$b''''''$ is applied to both of the distal surface 20$a_D''''''$ and the proximal surface 20$a_P''''''$ of the first material 20$a''''''$. As a result, the design of the cylindrical sleeve 12$''''''$ calls for even more utilization of the second material 20$b''''''$ (in comparison to the embodiment described at FIG. 7B), which increases manufacturing costs of the cylindrical sleeve 12$''''''$, but, however, provides six comfort points of contact when the user's, U, hands, H, comes into contact with the second material 20$b''''''$.

Because the second material 20$b''''$, 20$b''''''$, 20$b''''''$ is defined by a lower SS in comparison to, for example, a rough, cardboard-based paper material of the first material 20$a''''$, 20$a''''''$, 20$a''''''$, the assembly 10" may obviate use of gloves for the user's, U, hands, H, due to the increased comfort imparted to the user's, U, hands, H, by inclusion of the second material 20$b''''$, 20$b''''''$, 20$b''''''$ in the design of the cylindrical sleeve 12$''''$, 12$''''''$, 12$''''''$. Even further, because the second material 20$b''''$, 20$b''''''$, 20$b''''''$ is defined by a lower SS in comparison to, for example, a rough, cardboard-based paper material of the first material 20$a''''$, 20$a''''''$, 20$a''''''$, the assembly 10" obviates use of an axial insert, which may include, for example, hand grips, that would otherwise be inserted into the passage 22$''''$, 22$''''''$, 22$''''''$ extending through the cylindrical sleeve 12$''''$, 12$''''''$, 12$''''''$ due to the increased comfort imparted to the user's, U, hands, H, as described above.

Although FIGS. 6A-8C" illustrate the cylindrical sleeve 12$''''$, 12$''''''$, 12$''''''$ may define right angles where the outer surface 18$''''$, 18$''''''$, 18$''''''$ meets each of the distal end 24$''''$, 24$''''''$, 24$''''''$ and the proximal end 26$''''$, 26$''''''$, 26$''''''$, the cylindrical sleeve 12$''''$, 12$''''''$, 12$''''''$ described above at FIGS. 6A-8C" may be formed to define any desirable shape. For example, as seen in FIG. 10, the outer surface 18$''''$, 18$''''''$, 18$''''''$ of the cylindrical sleeve 12$''''$, 12$''''''$, 12$''''''$ may meet each of the distal end 24$''''$, 24$''''''$, 24$''''''$ and the proximal end 26$''''$, 26$''''''$, 26$''''''$ of the cylindrical sleeve 12$''''$, 12$''''''$, 12$''''''$ in a manner to respectively define tapered, recessed or rounded corners that may defined by, for example, a radius, R. By forming the cylindrical sleeve 12$''''$, 12$''''''$, 12$''''''$ to include tapered, recessed or rounded corners, R, as described above, the cylindrical sleeve 12$''''$, 12$''''''$, 12$''''''$ may further promote increased comfort to the user's, U, hands, H, in comparison to, for example, a cylindrical sleeve 12$''''$, 12$''''''$, 12$''''''$ including right angles where the outer surface 18$''''$, 18$''''''$, 18$''''''$ meets each of the distal end 24$''''$, 24$''''''$, 24$''''''$ and the proximal end 26$''''$, 26$''''''$, 26$''''''$.

Referring to FIGS. 11A-11C, an assembly is shown generally at 10". The assembly 10" includes a cylindrical sleeve 12$^8$ and a wound roll 14. A length of material, F, that is wound upon itself may define the wound roll 14.

In some implementations, the length of material, F, may be a length of wrapping film. As seen in FIG. 14, the length of wrapping film, F, may be dispensed/unwound from the wound roll 14 by a user, U, such that the length of wrapping film, F, may be disposed about and wrap a plurality of goods, G, that are arranged upon a pallet, P. Although some implementations of the length of material, F, may include a length of wrapping film, the length of material, F, may not be limited to including a length of wrapping film, and may alternatively include, for example, a length of paper, a length of tin foil or the like.

Referring back to FIGS. 11A-11C, the cylindrical sleeve 12$^8$ may include an inner surface 16$^8$ and an outer surface 18$^8$. The cylindrical sleeve 12$^8$ is defined by a body 20$^8$ of a first material 20$a^8$ (see, e.g., FIG. 13A), a second material 20$b^8$ (see, e.g., FIG. 13A) and a third material 20$c^8$ (see, e.g., FIG. 13A). In some instances, the body 20$^8$ may include two materials whereby the first material is identified at 20$a^8$ and the second material is identified at reference numerals 20$b^8$, 20$c^8$ (i.e., the materials 20$b^8$, 20$c^8$, although shown to have different cross-hatching, may be the same material).

Referring to FIG. 11A, the body 20$^8$ is defined by a thickness, 20$_T{}^8$, extending between the inner surface 16$^8$ and the outer surface 18$^8$. As seen in FIG. 12A, each of the first material 20$a^8$, the second material 20$b^8$ and the third material 20$c^8$ includes a substantially constant thickness throughout their respective lengths. In some instances, the second material 20$b^8$ and the third material 20$c^8$ may extend along the entire length of the first material 20$a^8$ to thereby define the body 20$^8$ to have a constant thickness, 20$_T{}^8$, between the inner surface 16$^8$ and the outer surface 18$^8$ along the length, 12$_L$, of the cylindrical sleeve 12$^8$.

The inner surface 16$^8$ defines a passage 22$^8$ extending through the cylindrical sleeve 12$^8$ between a distal end 24$^8$ of the cylindrical sleeve 12$^8$ and a proximal end 26$^8$ of the cylindrical sleeve 12$^8$. Access to the passage 22$^8$ is permitted by a distal opening 28$^8$ formed in the distal end 24$^8$ of the cylindrical sleeve 12$^8$ and a proximal opening 30$^8$ formed in the proximal end 26$^8$ of the cylindrical sleeve 12$^8$.

Referring to FIG. 11A, the length of material, F, includes an inner surface, $F_1$, and an outer surface, $F_O$. A portion of the inner surface, $F_1$, of the length of material, $F_I$, forms a passage 32 extending through the wound roll 14. The outer surface 18$^8$ of the cylindrical sleeve 12$^8$ may be secured to the portion of the inner surface, $F_I$, of the length of material, F, that forms the passage 32 extending through the wound roll 14. In some implementations, an adhesive (not shown) may be disposed over one or both of the portion of the inner surface, $F_I$, of the length of material, F, that forms the passage 32 extending through the wound roll 14 and a portion of the outer surface 18$^8$ of the cylindrical sleeve 12$^8$ defined by the first material 20*a*$^8$ for securing the cylindrical sleeve 12$^8$ to the wound roll 14.

The assembly 10" is further defined by portions $\mathbf{12}_{LP\text{-}1}$, $\mathbf{12}_{LP\text{-}2}$ (see, e.g., FIG. 11C) of the cylindrical sleeve 12$^8$ that extend beyond axial ends 34, 36 (see, e.g., FIG. 11C) of the wound roll 14 due to the cylindrical sleeve 12$^8$ including a length $\mathbf{12}_L$ that is greater than a length $\mathbf{14}_L$ of the wound roll 14; accordingly, when the cylindrical sleeve 12$^8$ is disposed within the passage 32 extending through the wound roll 14, a first portion $\mathbf{12}_{LP\text{-}1}$ of the length $\mathbf{12}_L$ of the cylindrical sleeve 12$^8$ may extend beyond an upper axial end 34 of the wound roll 14 and a second portion $\mathbf{12}_{LP\text{-}2}$ of the length $\mathbf{12}_L$ of the cylindrical sleeve 12$^8$ may extend beyond a lower axial end 36 of the wound roll 14. Such an arrangement of the cylindrical sleeve 12$^8$ arranged relative the wound roll 14 permits a user to grasp the outer surface 18$^8$ of the cylindrical sleeve 12$^8$ defined by the portions $\mathbf{12}_{LP\text{-}1}$, $\mathbf{12}_{LP\text{-}2}$ of the length $\mathbf{12}_L$ of the cylindrical sleeve 12$^8$. In such implementations, one or more of the inner surface 16$^8$, the outer surface 18$^8$, the distal end 24$^8$ and the proximal end 26$^8$ that defines the portions $\mathbf{12}_{LP\text{-}1}$, $\mathbf{12}_{LP\text{-}2}$ of the length $\mathbf{12}_L$ of the cylindrical sleeve 12$^8$ may further include (e.g., is covered by) a material defined by a lower Sheffield Smoothness (SS) in comparison to, for example, a material including, for example, a rough, cardboard-based paper material that may be utilized for forming the cylindrical sleeve 12$^8$. The material defined by the lower SS may be, for example, the second material 20*b*$^8$ and the third material 20*c*$^8$.

In an example, as seen in FIG. 12A, both of the inner surface 16$^8$ and the outer surface 18$^8$ of the cylindrical sleeve 12$^8$ may meet each of the distal end 24$^8$ and the proximal end 26$^8$ of the cylindrical sleeve 12$^8$ in a manner to respectively define tapered, recessed or rounded corners, R. By forming the cylindrical sleeve 12$^8$ to include tapered, recessed or rounded corners, R, as described above, the cylindrical sleeve 12$^8$ may further promote increased comfort to the user's, U, hands, H, in comparison to, for example, a cylindrical sleeve 12$^8$ including right angles where each of the inner surface 16$^8$ and the outer surface 18$^8$ meets each of the distal end 24$^8$ and the proximal end 26$^8$.

Referring to FIGS. 12A and 13A, an exemplary cylindrical sleeve 12$^8$ is shown.

Referring to FIG. 13A, the body 20$^8$ defining the cylindrical sleeve 12$^8$ includes at least the first material 20*a*$^8$, the second material 20*b*$^8$ and the third material 20*c*$^8$.

The first material 20*a*$^8$ may include a cylindrical body having an inner surface 20*a*$^8$ (see, e.g., FIG. 13A) and an outer surface $\mathbf{20}a_O{}^8$ (see, e.g., FIG. 13A). The second material 20*b*$^8$ may include a cylindrical body having an inner surface $\mathbf{20}b_I{}^8$ (see, e.g., FIG. 13A) and an outer surface $\mathbf{20}b_O{}^8$ (see, e.g., FIG. 13A). The third material 20*c*$^8$ may include a cylindrical body having an inner surface $\mathbf{20}c_I{}^8$ (see, e.g., FIG. 13A) and an outer surface $\mathbf{20}c_O{}^8$ (see, e.g., FIG. 13A). All of the inner surface $\mathbf{20}b_I{}^8$ of the second material 20*b*$^8$ may define the inner surface 16$^8$ of the cylindrical sleeve 12$^8$. All of the outer surface $\mathbf{20}c_O{}^8$ of the third material 20*c*$^8$ may define the outer surface 18$^8$ of the cylindrical sleeve 12$^8$.

In some implementations, the first material 20*a*$^8$ may include a rough, cardboard-based paper material that includes, but is not limited to a new/virgin paper material or a recycled paper material. In some examples, each of the second material 20*b*$^8$ and the third material 20*c*$^8$ may include a paper material (e.g., a paper lining including a plush characteristic, such as velvet). In some instances, each of the second material 20*b*$^8$ and the third material 20*c*$^8$ may include a non-paper material (e.g., a plastic lining). Although the first material 20*a*$^8$ of FIG. 12A, which may include a rough, cardboard-based paper material, is shown including one layer of material, the first material 20*a*$^8$ is not limited to including one layer of material; accordingly, in some instances, the first material 20*a*$^8$, which may include a rough, cardboard-based paper material, may include a plurality of layers of material. In some examples, a multi-layer first material 20*a*$^8$ may be formed by winding a strip of rough, cardboard-based paper material (e.g., Brown Kraft paper, which may alternatively be referred to as recycled paper) on a mandrel in a spiral with edges of the rough, cardboard-based paper material arranged adjacent one another forming a spiral seam; subsequently, one or more second strips of rough, cardboard-based paper material may be wound over the first rough, cardboard-based paper material arranged upon the mandrel until the first material 20*a*$^8$ is formed to include a desired thickness. In some instances, if, for example, the rough, cardboard-based paper material paper is 0.025" thick, and, a desired thickness of the first material 20*a*$^8$ is 0.25", ten strips of rough, cardboard-based paper material may be utilized as described above for forming the first material 20*a*$^8$.

Comparatively, the Sheffield Smoothness (SS) of both of the second material 20*b*$^8$ and the third material 20*c*$^8$ is lower than a SS of the first material 20*a*$^8$; in some implementations, the first material 20*a*$^8$ may be defined by a SS greater than 350 (e.g., a SS that is approximately equal to 370). In some implementations, both of the second material 20*b*$^8$ and the third material 20*c*$^8$ may be defined by a SS that is less than 350; in an exemplary embodiment, both of the second material 20*b*$^8$ and the third material 20*c*$^8$ may be defined by a SS approximately equal to 250.

With reference to FIG. 14, and, as described above at FIGS. 11A-13A, both of the second material 20*b*$^8$ and the third material 20*c*$^8$, which includes a lower SS than the first material 20*a*$^8$, may respectively define one or more of: the inner surface 16$^8$ and the outer surface 18$^8$ of the cylindrical sleeve 12$^8$ including the portions $\mathbf{12}_{LP\text{-}1}$, $\mathbf{12}_{LP\text{-}2}$ of the length $\mathbf{12}_L$ of the cylindrical sleeve 12$^8$. The "lower" SS of both of the second material 20*b*$^8$ and the third material 20*c*$^8$ may be referenced in comparison to, for example, a "higher" SS of the first material 20*a*$^8$. Accordingly, as seen in FIG. 12A when: (1) a user, U, arranges his/her hands, H, about the portions $\mathbf{12}_{LP\text{-}1}$, $\mathbf{12}_{LP\text{-}2}$ of the length $\mathbf{12}_L$ of the cylindrical sleeve 12$^8$ and (2) the wound roll 14 spins about an axis of rotation, A-A, as the length of wrapping film, F, is dispensed/unwound from the wound roll 14, the lower SS of both of the second material 20*b*$^8$ and the third material 20*c*$^8$ promotes increased comfort to the user's, U, hands, H, in comparison to, for example, a cylindrical sleeve that consists only of, for example, a rough, cardboard-based paper material.

Because both of the second material 20*b*$^8$ and the third material 20*c*$^8$ are defined by a lower SS in comparison to, for example, a rough, cardboard-based paper material of the first material 20*a*$^8$, the assembly 10" may obviate use of gloves for the user's, U, hands, H, due to the increased comfort imparted to the user's, U, hands, H, by inclusion of both of the second material 20*b*$^8$ and the third material 20*c*$^8$ in the design of the cylindrical sleeve 12$^8$. Even further, because both of the second material 20*b*$^8$ and the third material 20*c*$^8$ are defined by a lower SS in comparison to, for example, a rough, cardboard-based paper material of the first material 20*a*$^8$, the assembly 10" obviates use of an axial insert, which may include, for example, hand grips, that would otherwise be inserted into the passage 22$^8$ extending through the cylindrical sleeve $12^8$ due to the increased comfort imparted to the user's, U, hands, H, as described above.

A number of implementations have been described. Nevertheless, it will be understood that various modifications may be made without departing from the spirit and scope of the disclosure. Accordingly, other implementations are within the scope of the following claims. For example, the actions recited in the claims can be performed in a different order and still achieve desirable results.

The invention claimed is:

1. An assembly, comprising:

a cylindrical sleeve including an inner surface and an outer surface, wherein the inner surface of the cylindrical sleeve defines a passage extending through the cylindrical sleeve; and a length of material that is wound upon itself defining a wound roll, wherein the length of material includes an inner surface and an outer surface, wherein a portion of the inner surface of the length of material forms a passage extending through the wound roll, wherein the outer surface of the cylindrical sleeve is secured to the portion of the inner surface of the length of material that forms the passage extending through the wound roll, wherein the wound roll forms a first axial end and a second axial end, wherein the wound roll is defined by a length extending between the first axial end and the second axial end, wherein the cylindrical sleeve forms a distal end and a proximal end, wherein the cylindrical sleeve is defined by a length extending between the distal end and the proximal end, wherein a first portion of the length of the cylindrical sleeve extends beyond at least one of the first axial end of the wound roll and the second axial end of the wound roll, and wherein the first portion of the length of the cylindrical sleeve is defined by a Sheffield Smoothness that is less than 350.

2. The assembly of claim 1, wherein the Sheffield Smoothness defined by the first portion of the cylindrical sleeve is approximately equal to 250.

3. The assembly of claim 2, wherein the Sheffield Smoothness defined by a second portion of the cylindrical sleeve is greater than 350.

4. The assembly of claim 1, wherein the passage extends through the cylindrical sleeve between a distal end of the cylindrical sleeve and a proximal end of the cylindrical sleeve, wherein access to the passage is permitted by a distal opening formed in the distal end of the cylindrical sleeve and a proximal opening formed in the proximal end of the cylindrical sleeve.

5. The assembly of claim 1, further comprising at least one annular ring positioned proximate at least one of the distal end and the proximal end of the cylindrical sleeve, and wherein at least a portion of the at least one annular ring is defined by a Sheffield Smoothness that is less than 350.

6. The assembly of claim 1, wherein at least one of the distal end and the proximal end of the cylindrical sleeve includes at least a portion that is at least one of tapered, recessed, and rounded.

7. The assembly of claim 6, wherein the at least one of the distal end and the proximal end includes at least a portion that is defined by a Sheffield Smoothness that is less than 350.

8. The assembly of claim 1, wherein the first portion of the cylindrical sleeve includes at least one of a plastic coating, a plastic liner, and a paper liner.

9. An assembly, comprising:

a cylindrical sleeve including an inner surface and an outer surface, wherein the inner surface of the cylindrical sleeve defines a passage extending through the cylindrical sleeve; and a length of material that is wound upon itself defining a wound roll, wherein the length of material includes an inner surface and an outer surface, wherein a portion of the inner surface of the length of material forms a passage extending through the wound roll, wherein the outer surface of the cylindrical sleeve is secured to the portion of the inner surface of the length of material that forms the passage extending through the wound roll, wherein the wound roll forms a first axial end and a second axial end, wherein the wound roll is defined by a length extending between the first axial end and the second axial end, wherein the cylindrical sleeve forms a distal end and a proximal end, wherein the cylindrical sleeve is defined by a length extending between the distal end and the proximal end, wherein a first portion of the length of the cylindrical sleeve extends beyond at least one of the first axial end of the wound roll and the second axial end of the wound roll, wherein the cylindrical sleeve includes a first material and a second material, the second material has a Sheffield Smoothness that is less than the Sheffield Smoothness of the first material, and wherein the first portion of the length of the cylindrical sleeve includes the second material.

10. The assembly of claim 9, wherein the passage extends through the cylindrical sleeve between a distal end of the cylindrical sleeve and a proximal end of the cylindrical sleeve, wherein access to the passage is permitted by a distal opening formed in the distal end of the cylindrical sleeve and a proximal opening formed in the proximal end of the cylindrical sleeve.

11. The assembly of claim 9, further comprising at least one annular ring positioned proximate at least one of the distal end and the proximal end of the cylindrical sleeve, and wherein the at least one annular ring includes the second material.

12. The assembly of claim 9, wherein at least one of the distal end and the proximal end of the cylindrical sleeve includes at least a portion that is at least one of tapered, recessed, and rounded.

13. The assembly of claim 12, wherein the at least one of the distal end and the proximal end includes the second material.

14. An assembly, comprising:

a cylindrical sleeve including an inner surface and an outer surface, wherein the inner surface of the cylindrical sleeve defines a passage extending through the cylindrical sleeve; and a length of material that is wound upon itself defining a wound roll, wherein the length of material includes an inner surface and an outer surface, wherein a portion of the inner surface of the length of material forms a passage extending through the wound roll, wherein the outer surface of the cylindrical sleeve is secured to the portion of the inner surface of the length of material that forms the passage extending through the wound roll, wherein the cylindrical sleeve includes a first material and a second material, the second material having a Sheffield Smoothness that is less than the Sheffield Smoothness of the first material and wherein at least a portion of the inner surface of the cylindrical sleeve includes the second material.

15. The assembly of claim 14, wherein the passage extends through the cylindrical sleeve between a distal end of the cylindrical sleeve and a proximal end of the cylindrical sleeve, wherein access to the passage is permitted by a distal opening formed in the distal end of the cylindrical sleeve and a proximal opening formed in the proximal end of the cylindrical sleeve.

16. The assembly of claim 14, further comprising at least one annular ring positioned proximate at least one of the distal end and the proximal end of the cylindrical sleeve, and wherein the at least one annular ring includes the second material.

17. The assembly of claim 14, wherein the first material is a rough, cardboard-based paper material.

18. The assembly of claim 14, wherein the second material is a paper liner.

19. The assembly of claim 18, wherein the paper liner includes velvet.

20. The assembly of claim 14, wherein the second material is at least one of a plastic liner and a plastic coating.

* * * * *